US007384110B2

(12) United States Patent
Hoshiyama et al.

(10) Patent No.: US 7,384,110 B2
(45) Date of Patent: Jun. 10, 2008

(54) METHOD FOR ADJUSTMENT AND PRINTING SYSTEM

(75) Inventors: Yoshiko Hoshiyama, Nagano-ken (JP); Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 200 days.

(21) Appl. No.: 11/012,282

(22) Filed: Dec. 16, 2004

(65) Prior Publication Data

US 2005/0248606 A1 Nov. 10, 2005

(30) Foreign Application Priority Data

Dec. 16, 2003 (JP) ..... 2003-418670
Jan. 9, 2004 (JP) ..... 2004-004199

(51) Int. Cl.
*B41J 29/393* (2006.01)

(52) U.S. Cl. ..... 347/9; 347/5; 347/12

(58) Field of Classification Search ..... 347/19, 347/22–24, 74
See application file for complete search history.

(56) References Cited

U.S. PATENT DOCUMENTS 6,039,427 A * 3/2000 Kanome ..... 347/19
6,488,353 B1 * 12/2002 Itoyama et al. ..... 347/19
6,637,853 B1 * 10/2003 Ahne et al. ..... 347/19

FOREIGN PATENT DOCUMENTS

JP 2000-296608 A 10/2000

* cited by examiner

*Primary Examiner*—Lam S Nguyen
(74) *Attorney, Agent, or Firm*—Sughrue Mion, PLLC

(57) ABSTRACT

A method for adjustment of a printing apparatus, includes the steps of: (i) receiving an instruction from a user via a user interface; (ii) forming a plurality of patterns on a medium using an ink ejecting section that ejects ink onto the medium, each of the patterns being a pattern for adjusting a different object; (iii) detecting each of the patterns with a sensor; and (iv) adjusting each of the plurality of objects based on a result of detecting each of the patterns. With this adjustment method, if the image quality of the printed image has dropped, even a user who is not well versed in an inkjet printer's functionality can achieve an appropriate image quality improvement.

2 Claims, 31 Drawing Sheets

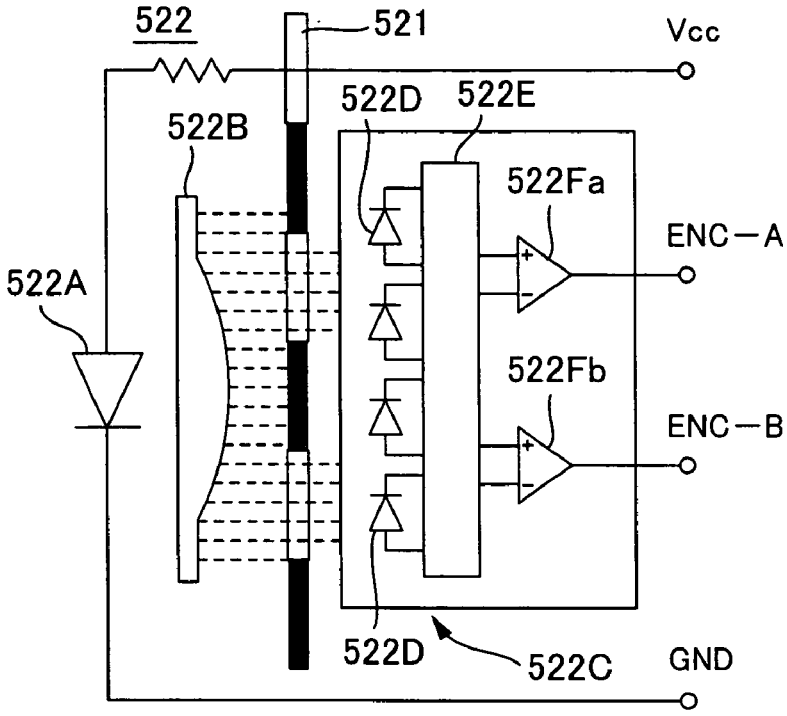
Fig.7
Fig.8A
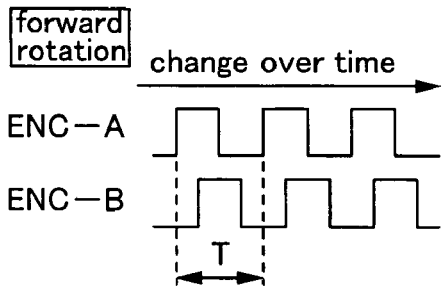
Fig.8B
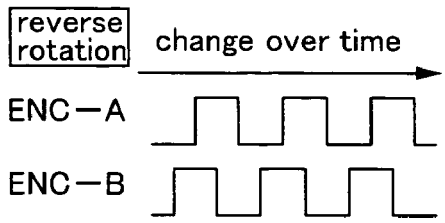

METHOD FOR ADJUSTMENT AND PRINTING SYSTEM

CROSS-REFERENCE TO RELATED APPLICATIONS

The present application claims priority upon Japanese Patent Application No. 2003-418670 filed on Dec. 16, 2003, and Japanese Patent Application No. 2004-004199 filed on Jan. 9, 2004, which are herein incorporated by reference.

FIELD OF THE INVENTION

The present invention relates to adjustment methods and printing systems.

DESCRIPTION OF THE RELATED ART

Inkjet printers are known as one type of printing apparatus that executes printing by ejecting a liquid toward a medium. Inkjet printers are configured so as to print by ejecting ink as the liquid onto a medium such as paper. In such inkjet printers, the image quality of printed images may deteriorate for various reasons. In this case, the user can enter, through a user interface, an appropriate instruction to carry out an adjustment of the inkjet printer, and can thus improve the drop in image quality-(see for example JP 2000-296608A).

However, if the user is not well versed in the inkjet printer's functionality, the user may not know the reason why the image quality of the printed image has deteriorated, so that there is the possibility that the user cannot enter, through the user interface, an appropriate instruction for carrying out the adjustment of the inkjet printer and thus cannot perform a proper improvement of the image quality.

SUMMARY OF THE INVENTION

In view of the above-described circumstances, it is an object of the present invention to allow even users who are not well versed with an inkjet printer's functionality to perform a suitable improvement of the image quality.

A first invention for attaining the above-noted objects is a method for adjustment of a printing apparatus, comprising the steps of:

receiving an instruction from a user via a user interface;

forming a plurality of patterns on a medium using an ink ejecting section that ejects ink onto the medium, each of the patterns being a pattern for adjusting a different object;

detecting each of the patterns with a sensor; and adjusting each of the plurality of objects based on a result of detecting each of the patterns.

A second invention for attaining the above-noted objects is a method for adjustment of a printing apparatus, comprising:

preparing the printing apparatus in which a plurality of different objects are adjustable;

displaying, on a user interface through which a user inputs an instruction, a plurality of image-quality display sections that each indicates an image-quality state; and if one of the plurality of image-quality display sections has been selected through the user interface and if two or more of the objects are correlated to the selected image-quality display section, performing an adjustment process for adjusting these two or more of the objects.

Features and objects of the present invention other than the above will be made clear by the reading the present specification with reference to the accompanying drawings.

BRIEF DESCRIPTION OF THE DRAWINGS

FIG. 7 is an explanatory diagram of a rotary encoder.

FIG. 8A is a timing chart of the waveforms of the output signals when a carry motor is rotating forward. FIG. 8B is a timing chart of the waveforms of the output signals when the carry motor is rotating in reverse.

Figure 1:
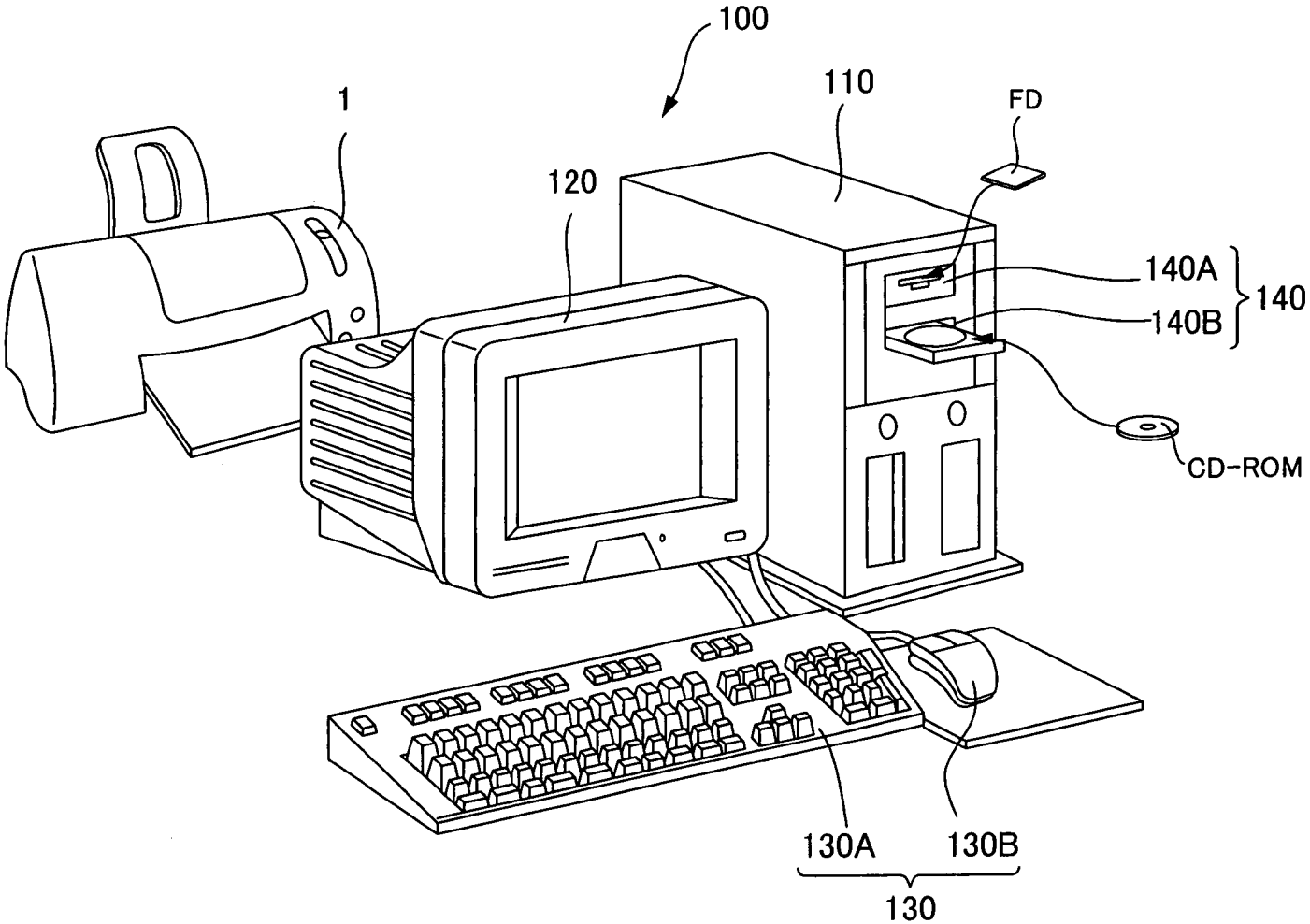
FIG. 1 is an explanatory drawing showing the external structure of a printing system.

For a more complete understanding of the present invention and the advantages thereof, reference is now made to the following description taken in conjunction with the accompanying drawings.

DESCRIPTION OF PREFERRED EMBODIMENTS

===Overview of the Disclosure ===

At least the following matters will be made clear by the explanation in the present specification and the description of the accompanying drawings.

A method for adjustment of a printing apparatus, comprises the steps of:

receiving an instruction from a user via a user interface;

forming a plurality of patterns on a medium using an ink ejecting section that ejects ink onto the medium, each of the patterns being a pattern for adjusting a different object;

detecting each of the patterns with a sensor; and adjusting each of the plurality of objects based on a result of detecting each of the patterns.

With this adjustment method, if the image quality of the printed images has dropped, even a user who is not well versed in an inkjet printer's functionality can achieve an adequate improvement of the image quality.

It is preferable that the sensor is an optical sensor comprising a light-emitting section irradiating light onto the patterns and a light-receiving section detecting light reflected from the patterns. In this way, the patterns can be detected more accurately.

It is preferable that the ink ejecting section comprises a plurality of nozzles; and one of the plurality of objects is clogging of the nozzles. In this way, clogging of the nozzles can be adjusted.

It is preferable that the pattern for adjusting clogging of the nozzles is made of a plurality of blocks, each block being formed by the ink ejected from a specific nozzle of the plurality of nozzles. In this way, clogged nozzles can be easily specified.

It is preferable that clogging of the nozzles is adjusted by cleaning the ink ejecting section. In this way, clogged nozzles can be restored.

It is preferable that the adjustment of clogging of the nozzles is carried out prior to the adjustment of other objects besides clogging of the nozzles. In this way, the adjustment of objects other than clogging can be carried out appropriately.

It is preferable that the ink ejecting section is capable of moving while ejecting ink; and one of the plurality of objects is a timing at which ink is ejected from the moving ink ejecting section. In this way, the dot formation positions can be adjusted.

It is preferable that the pattern for adjusting the timing is made of a plurality of correction patterns; and each of the correction patterns comprises a first dot row group formed by the ink ejected by the moving ink ejecting section in a forward pass and a second dot row group formed by the ink ejected by the moving ink ejecting section in a return pass. In this way, the dot formation positions of the forward pass and the return pass can be adjusted.

It is preferable that the first dot row group comprises a plurality of dot rows formed at a predetermined pitch in a movement direction of the ink ejecting section; the second dot row group comprises a plurality of dot rows formed at the same pitch as the dot rows of the first dot row group; and a shift amount of each of the correction patterns by which the first dot row group is shifted with respect to the second dot row group is different from the shift amount of another one of the correction patterns by a predetermined difference. In this way, it is possible to adjust the timing at which ink is ejected from the ink ejecting section by selecting the correction pattern in which the dot rows of the first dot row group and the dot rows of the second dot row group are best aligned in the movement direction of the ink ejecting section.

It is preferable that the pattern for adjusting the timing comprises a fine adjustment pattern in which the predetermined difference between the shift amounts is small and a coarse adjustment pattern in which the predetermined difference between the shift amounts is larger than the predetermined pitch of the fine adjustment pattern; and the fine adjustment pattern is formed in accordance with the shift amount determined based on the coarse adjustment pattern. In this way, it is possible to adjust the timing at which ink is ejected from the ink ejecting section in a short time and with high precision by selecting the correction pattern in which the dot rows of the first dot row group and the dot rows of the second dot row group are best aligned in the movement direction of the ink ejecting section.

It is preferable that the printing apparatus comprises a carrying section for carrying the medium; and one of the plurality of objects is a carry amount by which the carrying section carries the medium. In this way, the carry amount can be adjusted.

It is preferable that the pattern for adjusting the carry amount includes a plurality of boundary regions constituted by a first pattern formed by the ink ejected from a portion of the ink ejecting section on an upstream side in a carrying direction and a second pattern formed adjacent on the upstream side in the carrying direction to the first pattern by the ink ejected from a portion of the ink ejecting section on a downstream side in the carrying direction. The carry amount of the medium can be adjusted by detecting the boundary regions with the sensor.

It is preferable that a spacing between the first pattern and the second pattern differs for each of the plurality of boundary regions. In this way, the optimal pattern for adjusting the carry amount of the medium can be selected.

A printing system comprises:

an ink ejecting section ejecting ink onto a medium;

a sensor detecting patterns formed by the ink ejected onto the medium;

a user interface through which a user inputs an instruction; and a controller, the controller:

receiving an instruction from a user via the user interface;

causing the ink ejecting section to form a plurality of patterns, each of the patterns being a pattern for adjusting a different object;

causing the sensor to detect each of the patterns; and adjusting each of the plurality of objects based on a result of detecting each of the patterns.

With this printing system, if the image quality of the printed images has dropped, even a user who is not well versed in an inkjet printer's functionality can achieve an adequate improvement of the image quality.

A method for adjustment of a printing apparatus, comprises:

preparing the printing apparatus in which a plurality of different objects are adjustable;

displaying, on a user interface through which a user inputs an instruction, a plurality of image-quality display sections that each indicates an image-quality state; and if one of the plurality of image-quality display sections has been selected through the user interface and if two or more of the objects are correlated to the selected image-quality display section, performing an adjustment process for adjusting these two or more of the objects.

With this adjustment method, if the image quality of the printed images has dropped, even a user who is not well versed in an inkjet printer's functionality can achieve an adequate improvement of the image quality.

It is preferable that the printing apparatus comprises an ink ejecting section that ejects ink onto a medium while moving, and a sensor that detects patterns formed on the medium by the ink ejected from the ink ejecting section; and the adjustment process is a process of ejecting the ink onto the medium from the ink ejecting section, forming patterns for adjusting the respective objects, detecting each of the patterns with the sensor, and adjusting each of the plurality of objects based on a result of detecting each of the patterns. In this way, if the image quality of the printed images has dropped, even a user who is not well versed in an inkjet printer's functionality can achieve an adequate improvement of the image quality.

It is preferable that the printing apparatus comprises a carrying section that carries the medium; and the adjustment process for adjusting two or more of the objects comprises: a process of adjusting clogging of nozzles of the ink ejecting section; and a process of adjusting a carry amount by which the medium is carried by the carrying section. Also, it is preferable that, if the image-quality display section indicating that there are streaks on the medium that has been printed is selected, then the process of adjusting clogging of the nozzles of the ink ejecting section and the process of adjusting the carry amount by which the medium is carried by the carrying section are carried out. In this way, if there are streaks in the printed image, the image quality can be improved.

It is preferable that, if a first image-quality display section indicating a first image-quality state is selected, then an adjustment process corresponding to the first image-quality display section is carried out; if a second image-quality display section indicating a second image-quality state is selected, then an adjustment process corresponding to the second image-quality display section is carried out; and if a third image-quality display section indicating the first image-quality state and the second image-quality state is selected, then the adjustment process corresponding to the first image-quality display section and the adjustment process corresponding to the second image-quality display section are carried out. Moreover, it is preferable that the printing apparatus comprises a carrying section that carries the medium; the adjustment process corresponding to the first image-quality display section is a process of adjusting a position at which the ink ejected from the ink ejecting section lands on the medium; and the adjustment process corresponding to the second image-quality display section is a combination of a process of adjusting clogging of nozzles of the ink ejecting section and a process of adjusting a carry amount by which the medium is carried by the carrying section.

The process of adjusting clogging of the nozzles of the ink ejecting section is carried out prior to executing other processes. In this way, objects other than clogging can be suitably adjusted. Also, the process of adjusting clogging of the ink ejecting section is a process of cleaning the ink ejecting section. In this way, clogged nozzles can be restored.

It is preferable that the sensor is an optical sensor comprising a light-emitting section irradiating light onto the patterns and a light-receiving section detecting light reflected from the patterns.

A printing system comprises:

a printing apparatus in which a plurality of different objects are adjustable;

a user interface through which a user inputs an instruction and which displays a plurality of image-quality display sections that each indicates an image-quality state; and a controller, wherein:

if one of the plurality of image-quality display sections has been selected through the user interface and if two or more of the objects are correlated to the selected image-quality display section, then the controller causes the printing apparatus to perform an adjustment process for adjusting these two or more of the objects.

With this printing system, if the image quality of the printed images has dropped, even a user who is not well versed in an inkjet printer's functionality can achieve an adequate improvement of the image quality.

First Embodiment

===(1) Configuration of Printing System===

An embodiment of a printing system (computer system) is described next with reference to the drawings. However, the description of the following embodiment also encompasses implementations relating to a computer program and a storage medium storing the computer program, for example.

FIG. 1 is an explanatory diagram showing the external structure of the printing system. A printing system 100 is provided with a printer 1, a computer 110, a display device 120, input devices 130, and record/play devices 140. The printer 1 is a printing apparatus for printing images on a medium such as paper, cloth, or film. The computer 110 is electrically connected to the printer 1, and outputs print data corresponding to an image to be printed to the printer 1 in order to make the printer 1 print the image. The display device 120 has a display, and displays a user interface of, for example, an application program or a printer driver. The input devices 130 are for example a keyboard 130A and a mouse 130B, and are used to operate an application program or adjust the settings of the printer driver, for example, in accordance with the user interface that is displayed on the display device 120. A flexible disk drive device 140A and a CD-ROM drive device 140B, for example, are employed as the record/play devices 140.

A printer driver is installed on the computer 110. The printer driver is a program for achieving the function of displaying the user interface on the display device 120, and for achieving the function of converting image data that has been output from the application program into print data. The printer driver is stored on a storage medium (computer-readable storage medium) such as a flexible disk FD or a CD-ROM. The printer driver also can be downloaded onto the computer 110 via the Internet. It should be noted that this program is made of codes for achieving various functions.

Note that "printing apparatus" in a narrow sense means the printer 1, but in a broader sense it means the system constituted by the printer 1 and the computer 110.

===(1) Printer Driver===

Regarding the Printer Driver

Figure 2:
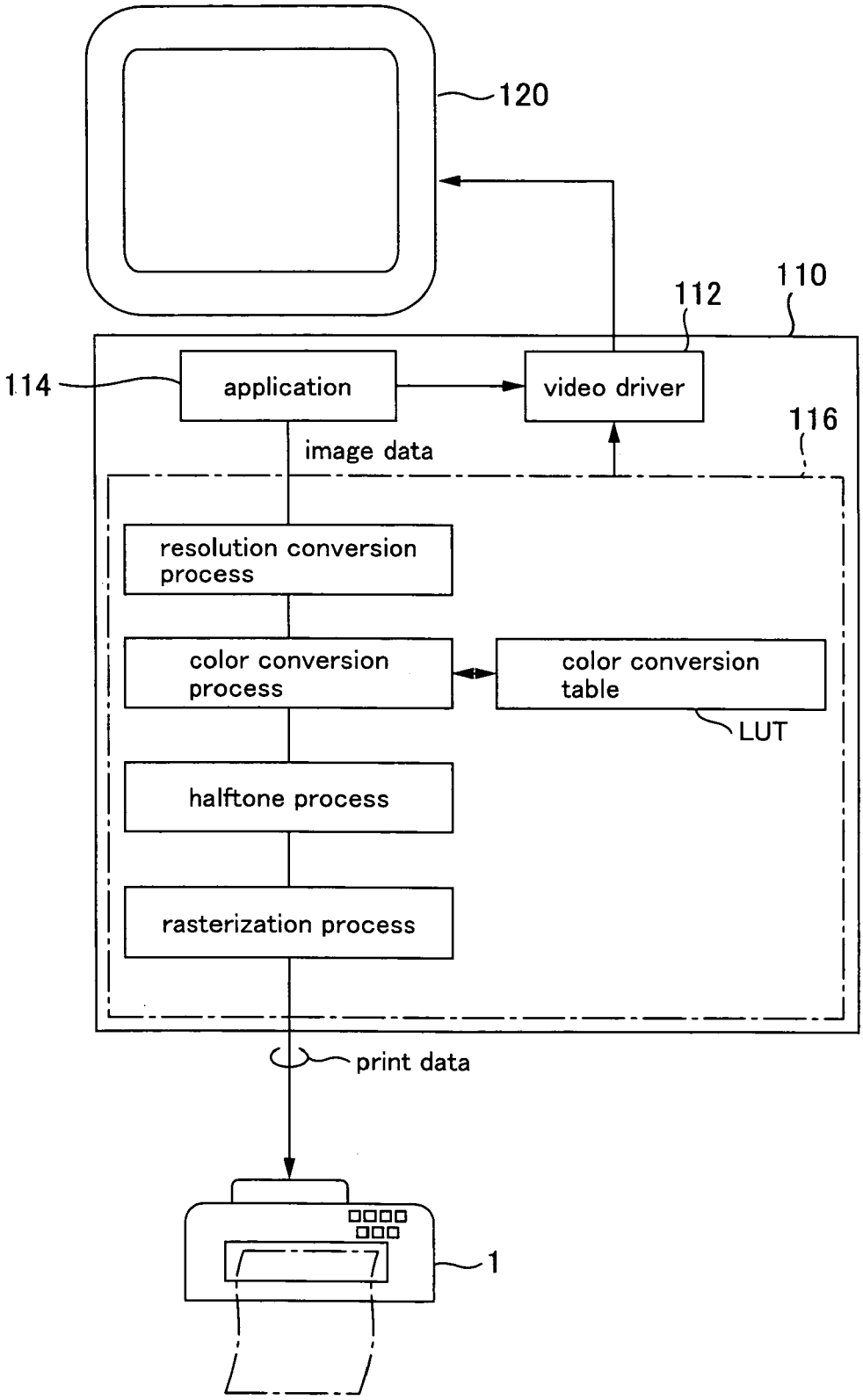
FIG. 2 is a schematic explanatory diagram of basic processes carried out by a printer driver.

FIG. 2 is a schematic explanatory diagram of basic processes carried out by the printer driver. Structural elements that have already been described are assigned identical reference numerals and thus further description thereof is omitted.

On the computer 110, computer programs such as a video driver 112, an application program 114, and a printer driver 116 operate under an operating system installed on the computer. The video driver 112 has a function of displaying, for example, the user interface on the display device 120 in accordance with display commands from the application program 114 and the printer driver 116. The application program 114 has such functions as enabling image editing and creates data related to an image (image data). A user can give an instruction to print an image edited by the application program 114 via the user interface of the application program 114. Upon receiving the print instruction, the application program 114 outputs the image data to the printer driver 116.

The printer driver 116 receives the image data from the application program 114, converts the image data to print data, and outputs the print data to the printer. Here, "print data" refers to data in a format that can be interpreted by the printer 1 and that includes various command data and pixel data. Here, "command data" refers to data for instructing the printer to carry out a specific operation. Furthermore, "pixel data" refers to data related to pixels that constitute an image to be printed (print image), for example, data related to dots to be formed in positions on the paper corresponding to pixels (data ragarding dot color and size, for example).

In order to convert the image data that is output from the application program 114 to print data, the printer driver 116 carries out processes such as resolution conversion processing, color conversion processing, halftone processing, and rasterization. Resolution conversion processing is a process in which image data (text data, image data, etc.) output from the application program 114 is converted to a resolution for printing on paper. Color conversion processing is a process in which RGB data is converted to CMYK data that is expressed using CMYK color space. Halftone processing is a process in which data of a high number of gradations is converted to data of a number of gradations that can be formed by the printer. Rasterization is a process in which image data in a matrix form is changed to data in an order suitable for transfer to the printer. Rasterized data is output to the printer as pixel data contained in the print data.

Regarding the Settings of the Printer Driver

Figure 3:
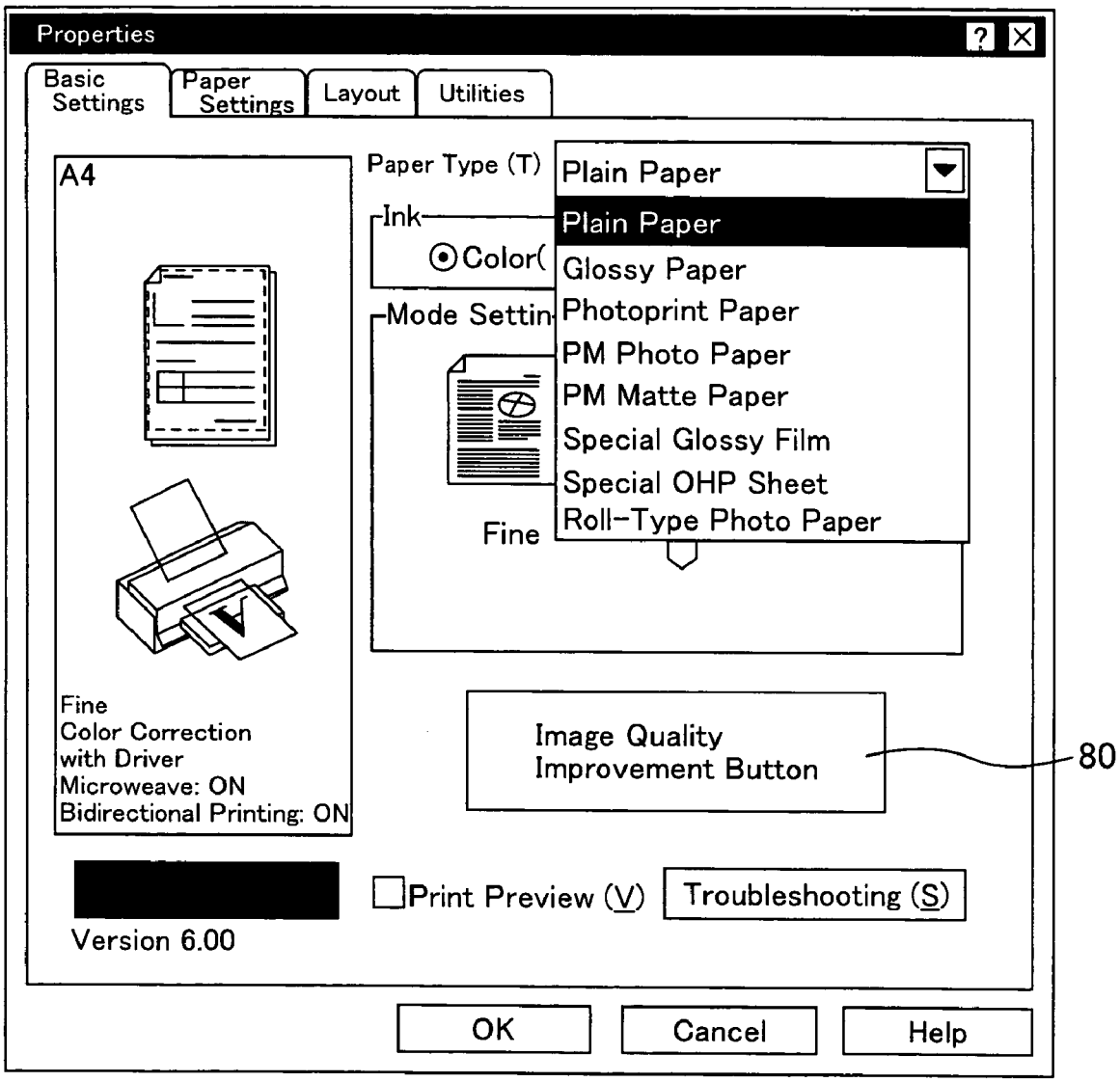
FIG. 3 is an explanatory diagram of a user interface of the printer driver.

FIG. 3 is an explanatory diagram of a user interface of the printer driver. The user interface of the printer driver is displayed on a display device via the video driver 112. The user can use the input device 130 to change the various settings of the printer driver.

The user can select the print mode from this screen. For example, the user can select as the print mode a quick print mode or a fine print mode. The printer driver then converts the image data to print data such that the data is in a format corresponding to the selected print mode.

Furthermore, from this screen, the user can select the print resolution (the dot spacing when printing). For example, the user can select, from this screen, 720 dpi or 360 dpi as the print resolution. The printer driver then carries out resolution conversion processing in accordance with the selected resolution and converts the image data to print data.

Furthermore, from this screen, the user can select the print paper to be used for printing. For example, the user can select plain paper or glossy paper as the print paper. Since the way an ink is absorbed and the way ink dries varies if the type of paper (paper grade) varies, the amount of ink suitable for printing also varies. For this reason, the printer driver converts the image data to print data in accordance with the selected paper grade. Note that "plain paper" is paper that is made only of a base and does not have a coating layer on its surface. On the other hand, "glossy paper" is paper in which the surface of the base is provided with a glossy coating layer. When ink lands on glossy paper, the ink penetrates adequately into the coating layer, so that high-quality images can be obtained if photos are printed on glossy paper.

Moreover, if the image quality of the printed images has dropped, the user can use this screen to input an instruction to improve image quality into the printing apparatus. In this case, using the mouse 130B, the user moves the cursor displayed on the screen to an image quality improvement button 80 located below the center of the screen. Then, the user can click with the mouse 130B while the cursor is on the image quality improvement button 80.

When the user has entered an instruction through the user interface, the printer driver causes ink to be ejected from an ink ejecting section, forms patterns for adjusting a plurality of different objects (in the present embodiment, clogging of the nozzles, ink ejection timing, and medium carry amount) on the medium, detects these patterns with a sensor, and adjusts each of the plurality of objects. Methods for adjusting the plurality of different objects are explained in more detail further below.

Next, the significance of providing the image quality improvement button 80 on the user interface is explained. If the user interface is not provided with the image quality improvement button 80 and the image quality of the printed image has dropped, then the user will try to analyze and identify the cause of the drop in image quality. The user then must enter an instruction to adjust the cause of the drop in image quality into the printer 1 through the user interface. However, if the user is not well versed in the functionality of the printing apparatus, then the user cannot accurately judge the cause of the drop in image quality. In this case, the user cannot enter the proper instruction for adjusting the cause of the drop in image quality into the printing apparatus through the user interface. To address this problem, the user interface of the present embodiment is provided with an image quality improvement button 80. Thus, even a user who is not well versed in the functionality of the printing apparatus can enter an instruction to improve image quality through the user interface into the printer driver by simply selecting this image quality improvement button 80. When the printer driver receives such an instruction to improve image quality, it lets the printing apparatus perform an image quality improvement process. The image quality improvement process carried out by the printing apparatus is described in detail further below.

Then, the printer driver converts image data to print data in accordance with the conditions that have been set via the user interface. It should be noted that, in addition to performing various settings of the printer driver, the user can also be notified, through this screen, of such information as the amount of ink remaining in the cartridges.

===(3) Configuration of Printer===

Regarding the Configuration of the Inkjet Printer

Figure 4:
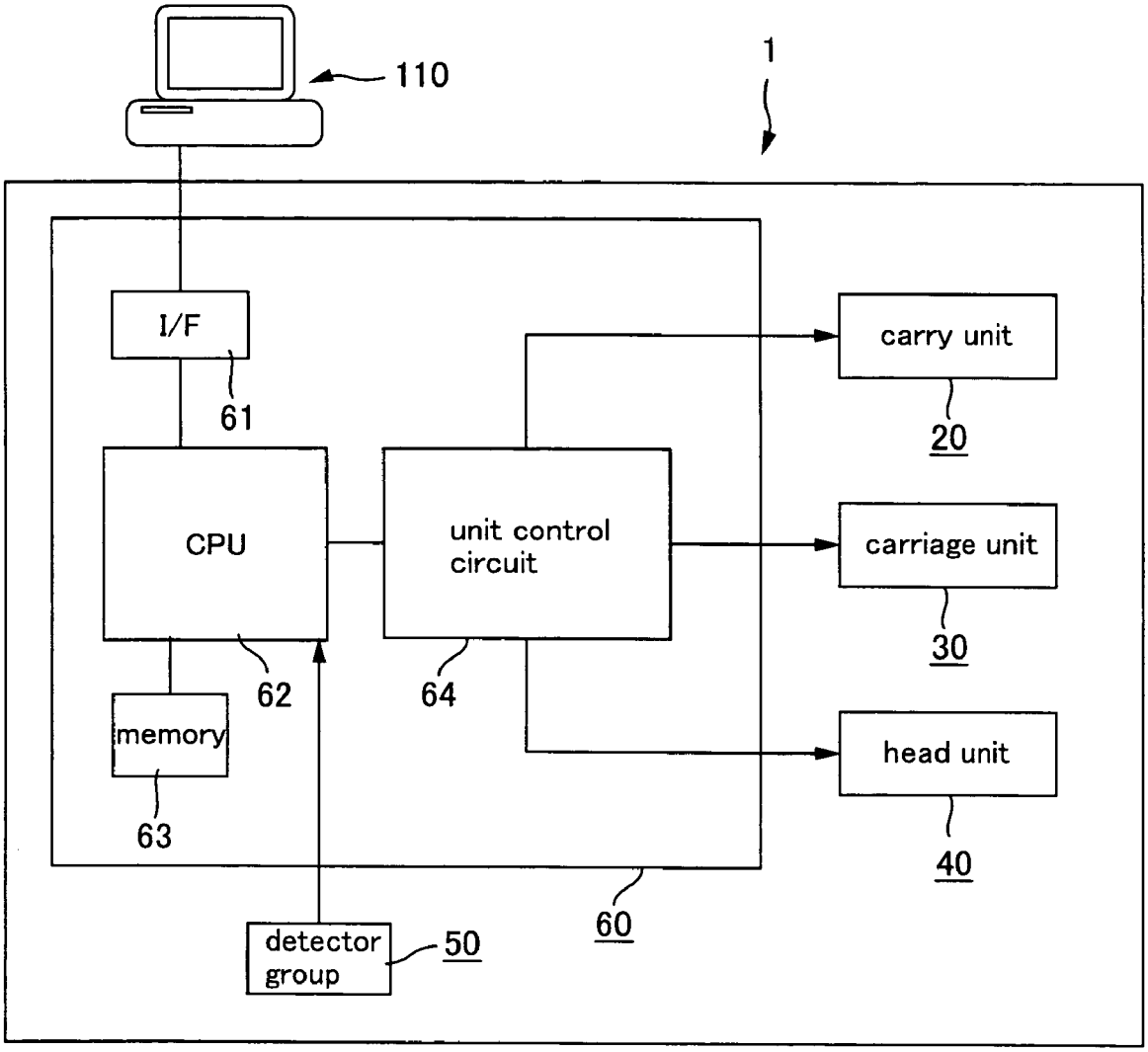
FIG. 4 is a block diagram of the overall configuration of a printer.
Figure 5:
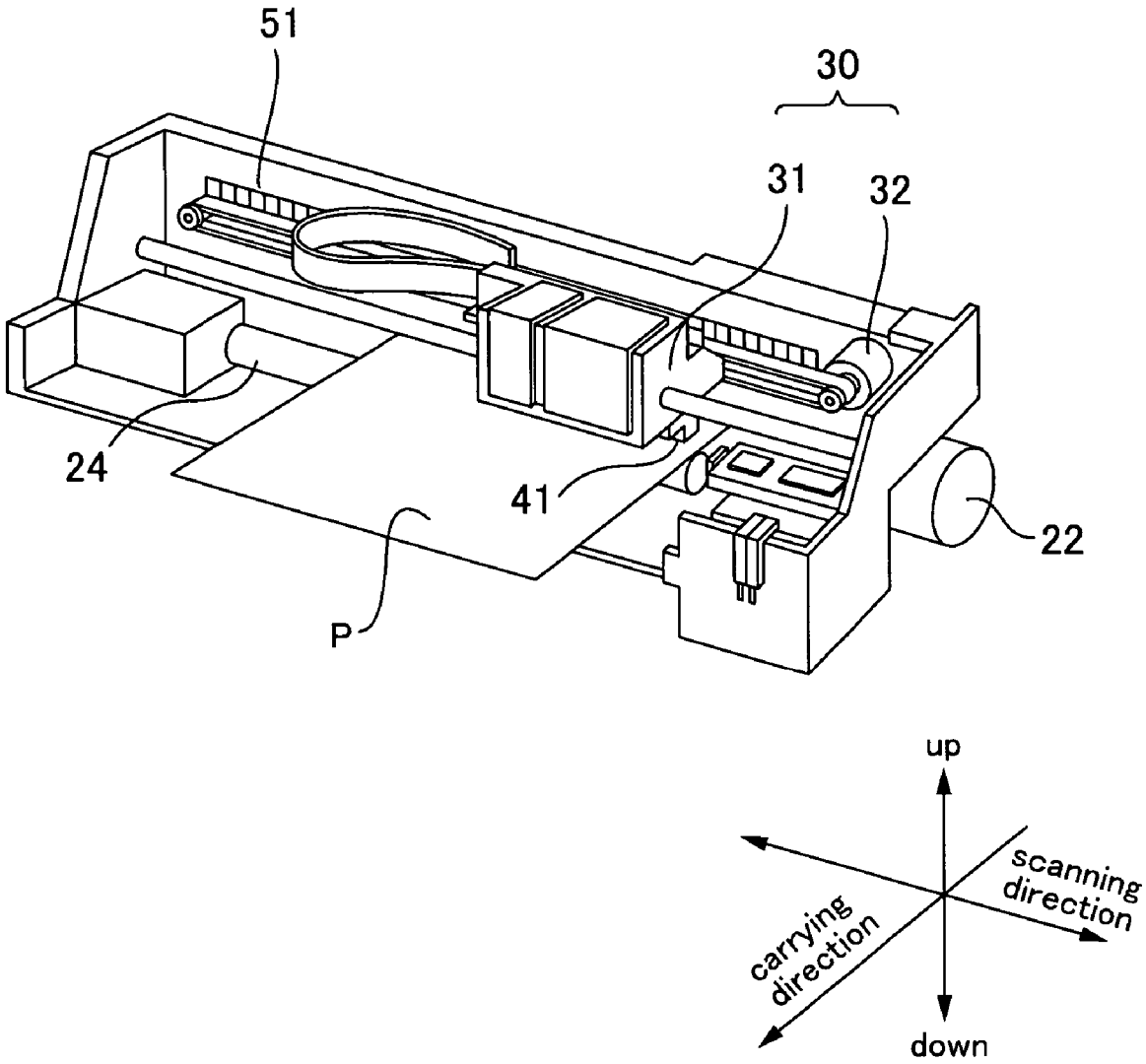
FIG. 5 is a schematic diagram of the overall configuration of the printer.
Figure 6:
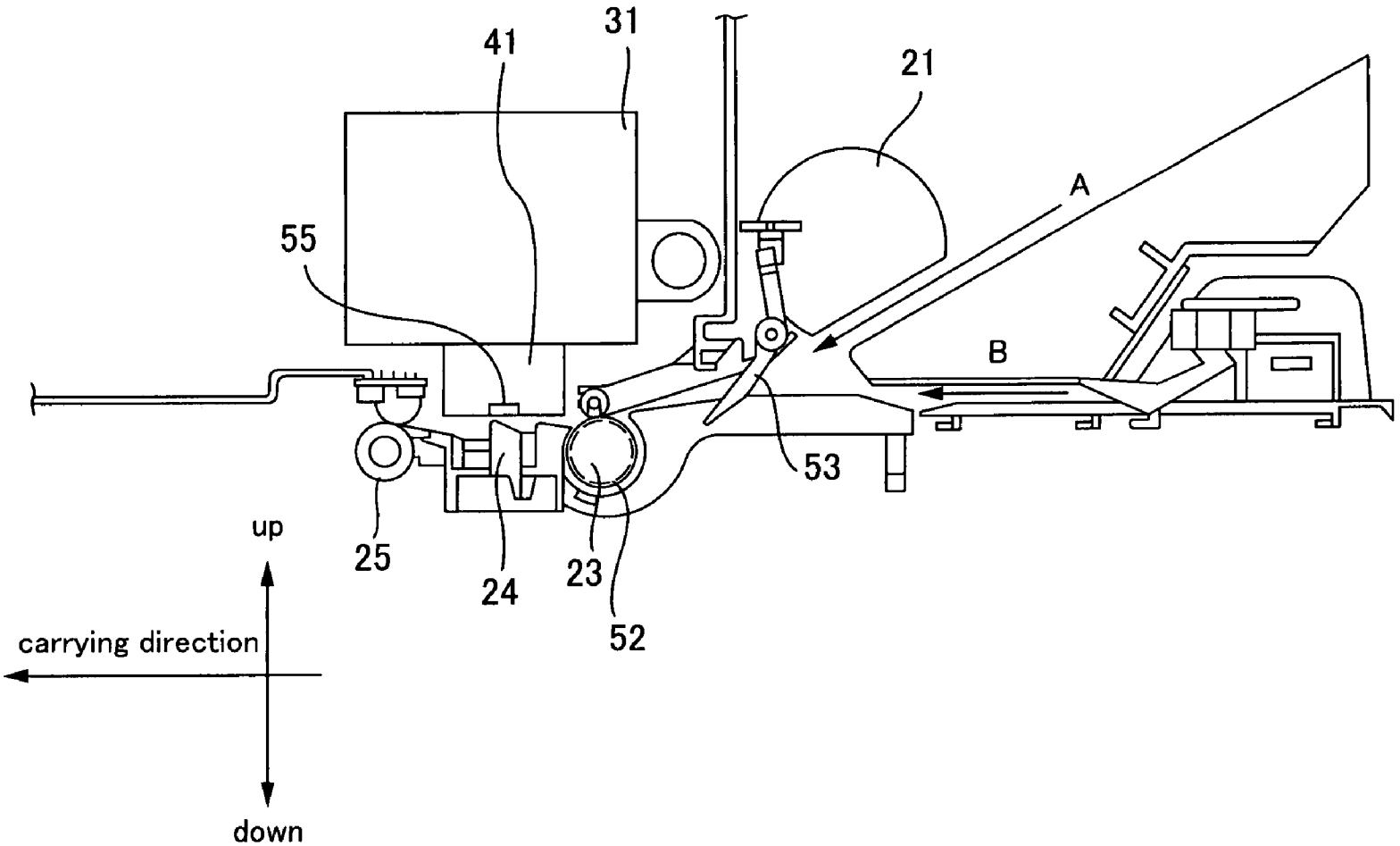
FIG. 6 is a transverse sectional view of the overall configuration of the printer.

FIG. 4 is a block diagram of the overall configuration of the printer of this embodiment. Further, FIG. 5 is a schematic diagram of the overall configuration of the printer of this embodiment. FIG. 6 is lateral sectional view of the overall configuration of the printer of this embodiment. The basic configuration of the printer according to the present embodiment is described below.

The printer of this embodiment has a carry unit 20, a carriage unit 30, a head unit 40, a detector group 50, and a controller 60. Having received print data from the computer 110, which is an external device, the printer 1 controls the various units (the carry unit 20, the carriage unit 30, and the head unit 40) using the controller 60. The controller 60 controls the units in accordance with the print data that has been received from the computer 110 to form an image on a paper. The detector group 50 monitors the conditions within the printer 1, and outputs the results of this detection to the controller 60. The controller receives the detection results from the detector group 50, and controls the various units based on these detection results.

The carry unit 20 is for feeding a medium (for example, print paper P) to a printable position and carrying the paper in a predetermined direction (hereinafter referred to as the carrying direction) by a predetermined carry amount during printing. In other words, the carry unit 20 functions as a carrying mechanism (a carrying means) for carrying paper. The carry unit 20 has a paper supply roller 21, a carry motor 22 (hereinafter also referred to as PF motor), a carry roller 23, a platen 24, and a paper discharge roller 25. However, the carry unit 20 does not necessarily have to include all of these structural elements in order to function as a carrying mechanism. The paper supply roller 21 is a roller for automatically supplying, into the printer, paper that has been inserted into a paper insert opening. The paper supply roller 21 has a cross-sectional shape in the shape of the letter D, and the length of its circumference is set longer than the carrying distance to the carry roller 23, so that the paper can be carried up to the carry roller 23 using this circumference. The carry motor 22 is a motor for carrying the paper in the carrying direction, and is constituted by a DC motor. The carry roller 23 is a roller for carrying the print paper P that has been supplied by the paper supply roller 21 up to a printable region, and is driven by the carry motor 22. The platen 24 supports the print paper P during printing. The paper discharge roller 25 is a roller for discharging the print paper P on which printing has finished to the outside of the printer. The paper discharge roller 25 is rotated in synchronization with the carry roller 23.

The carriage unit 30 is for moving the head in a predetermined direction. The carriage unit 30 has a carriage 31 and a carriage motor 32 (also referred to as "CR motor"). The carriage 31 can be moved back and fourth. Also, the carriage 31 detachably retains an ink cartridge containing ink. The carriage motor 32 is a DC motor for moving the carriage 31.

The head unit 40 is for ejecting ink onto paper. The head unit 40 has a head 41. The head 41 has a plurality of nozzles serving as an ink ejecting section and ejects ink intermittently from these nozzles. The head 41 is provided on the carriage 31. Thus, when the carriage 31 moves, the head 41 moves as well. A dot line (raster line) is formed on the paper as a result of the head 41 intermittently ejecting ink while moving.

The detector group 50 includes a linear encoder 51, a rotary encoder 52, a paper detection sensor 53, and an optical sensor 55, for example. The linear encoder 51 is for detecting the position of the carriage 31. The rotary encoder 52 is for detecting the amount of rotation of the carry roller 23. The paper detection sensor 53 is for detecting the position of the front end of the paper to be printed. The paper detection sensor 53 is provided in a position where it can detect the position of the front end of the paper as the paper is being fed toward the carry roller 23 by the paper supply roller 21. It should be noted that the paper detection sensor 53 is a mechanical sensor that detects the front end of the paper through a mechanical mechanism. More specifically, the paper detection sensor 53 has a lever that can be rotated in the carrying direction, and this lever is disposed such that it protrudes into the path over which the paper is carried. In this way, the front end of the paper comes into contact with the lever and the lever is rotated, and thus the paper detection sensor 53 detects the position of the front end of the paper by detecting the movement of the lever.

It should be noted that in the present embodiment, the detector group 50 includes an optical sensor 55. The optical sensor 55 is attached to the carriage 31. The optical sensor 55 detects the patterns formed on the paper, as a result of its light-receiving section detecting reflected light of the light that has been irradiated onto the paper from the light-emitting section. The configuration of this optical sensor 55 is explained in more detail further below, with reference to FIG. 13.

The controller 60 is a control unit (controlling means) for carrying out control of the printer. The controller 60 includes an interface section 61, a CPU 62, a memory 63, and a unit control circuit 64. The interface section 61 is for exchanging data between the computer 110, which is an external device, and the printer 1. The CPU 62 is an arithmetic processing unit for carrying out overall control of the printer. The memory 63 is for ensuring a working area and a area for storing the programs for the CPU 62, for instance, and includes storage means such as a RAM or an EEPROM. The CPU 62 controls the various units via the unit control circuit 64 in accordance with programs stored in the memory 63.

Regarding the Rotary Encoder

Next, the rotary encoder is described with reference to FIG. 7. FIG. 7 is an explanatory diagram of the detection section of the rotary encoder 52.

The rotary encoder 52 is for detecting the amount of rotation of the carry roller 23, and includes a scale and a detection section.

The scale is provided with slits arranged at predetermined intervals, and is provided on the side of the carry roller 23. That is, the scale rotates together with the carry roller 23 when the carry roller 23 is rotated. In the present embodiment, when the carry roller 23 is rotated such that the print paper P is carried by 1/1440 inch, the carry roller rotates by an amount corresponding to one slit interval.

The detection section is provided in opposition to the scale, and is fastened to the main printer unit side.

Next, the detection section of the rotary encoder 52 is described in more detail with reference to FIG. 7. The detection section 522 has a light-emitting diode 522A, a collimating lens 522B, and a detection processing section 522C. The detection processing section 522C is provided with a plurality of (for instance, four) photodiodes 522D, a signal processing circuit 522E, and two comparators 522Fa and 522Fb.

The light-emitting diode 522A emits light when a voltage Vcc is applied to it via resistors on both sides, and this light is incident on the collimating lens. The collimating lens 522B turns the light that is emitted from the light-emitting diode 522A into parallel light, and irradiates the parallel light on the scale 521. The parallel light that passes through the slits provided in the scale then passes through stationary slits (not shown) and is incident on the photodiodes 522D. The photodiodes 522D convert the incident light into electrical signals. The electrical signals that are output from the photodiodes are compared in the comparators 522Fa and 522Fb, and the results of these comparisons are output as pulses. Then, the pulse ENC-A and the pulse ENC-B that are output from the comparators 522Fa and 522Fb become the output of the rotary encoder 52.

FIG. 8A is a timing chart of the waveforms of the output signals when the carry motor 22 is rotating forward. FIG. 8B is a timing chart of the waveforms of the output signals when the carry motor 22 is rotating in reverse.

As shown in FIG. 8A and FIG. 8B, the phases of the pulse ENC-A and the pulse ENC-B are misaligned by 90 degrees both when the carry motor 22 is rotating forward and when it is rotating in reverse. When the carry motor 22 is rotating forward, that is, when the print paper P is carried in the carrying direction, then, as shown in FIG. 8A, the phase of the pulse ENC-A leads the phase of the pulse ENC-B by 90 degrees. On the other hand, when the carry motor 22 is rotating in reverse, that is, when the print paper P is carried in a direction opposite the carrying direction, then, as shown in FIG. 8B, the phase of the pulse ENC-A trails the phase of the pulse ENC-B by 90 degrees. A single period T of the pulses is equal to the time during which the carry roller 23 is rotated for an amount corresponding to the spacing of the slits of the scale 521 (for example, by 1/1440 inch (1 inch equals 2.54 cm)).

===(1) Regarding the Printing Operation===

Figure 9:
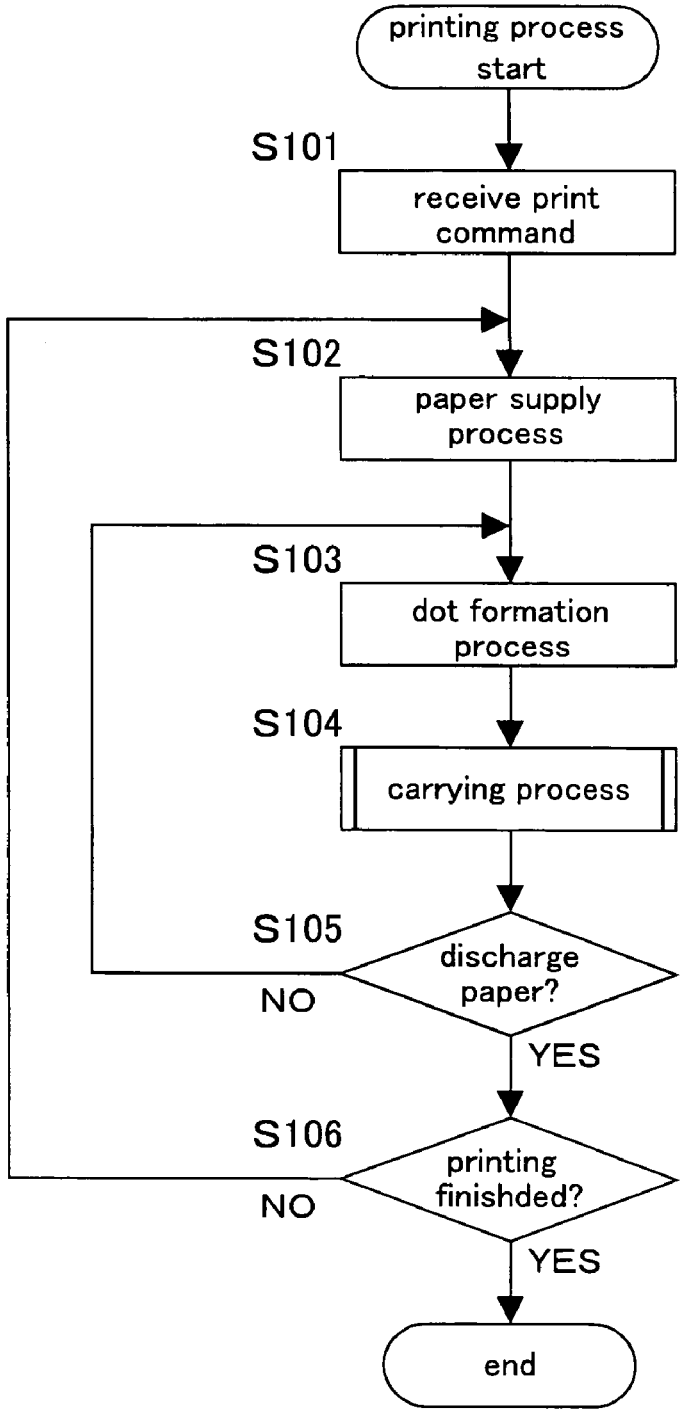
FIG. 9 is a flowchart of the processing during printing.

FIG. 9 is a flowchart of the processing during printing. The processes described below are executed by the controller 60 controlling the various units in accordance with a program stored in the memory 63. This program includes codes for executing the various processes.

The controller 60 receives a print command via the interface section 61 from the computer 110 (S101). This print command is included in the header of the print data transmitted from the computer 110. The controller 60 then analyzes the content of the various commands included in the print data that has been received and uses the units to perform the following paper supply process, dot formation process, and carrying process, for example.

First, the controller 60 performs the paper supply process (S102). The paper supply process is a process for supplying paper to be printed into the printer and positioning the paper at a print start position (also referred to as the "indexed position"). The controller 60 rotates the paper supply roller 21 to feed the paper to be printed up to the carry roller 23. The controller 60 rotates the carry roller 23 to position the paper that has been fed from the paper supply roller 21 at the print start position. When the paper has been positioned at the print start position, at least some of the nozzles of the head 41 are in opposition to the paper.

Next, the controller 60 performs the dot formation process (S103). The dot formation process is a process for intermittently ejecting ink from a moving head so as to form dots on the paper. The controller 60 drives the carriage motor 32 to move the carriage 31. The controller 60 then causes the head to eject ink in accordance with the print data while the carriage 31 is moving. Dots are formed on the paper when ink droplets ejected from the head land on the paper.

Next, the controller 60 performs the carrying process (S104). The carrying process is a process for moving the paper relative to the head in the carrying direction. The controller 60 drives the carry motor to rotate the carry roller and thereby carry the paper in the carrying direction. Through this carrying process, the head 41 can form dots at positions that are different from the positions of the dots formed in the preceding dot formation process.

This carrying process is explained in more detail further below, with reference to FIG. 10.

Next, the controller 60 determines whether or not to discharge the paper being printed (S105). The paper is not discharged if there is still data to be printed on the paper which is being printed. Then, the controller 60 alternately repeats the dot formation and carrying processes until there is no more data for printing, thus gradually printing an image made of dots on the paper. When there is no more data to be printed on the paper which is being printed, the controller 60 discharges that paper. The controller 60 discharges the printed paper to the outside by rotating the paper discharge roller. It should be noted that whether or not to discharge the paper can also be decided based on a paper discharge command included in the print data.

Next, the controller 60 decides whether or not to continue printing (S106). If the next sheet of paper is to be printed, then printing is continued and the paper supply process for the next sheet of paper is started. If the next sheet of paper is not to be printed, then the printing operation is ended.

Regarding the Carrying of the Print Paper

Figure 10:
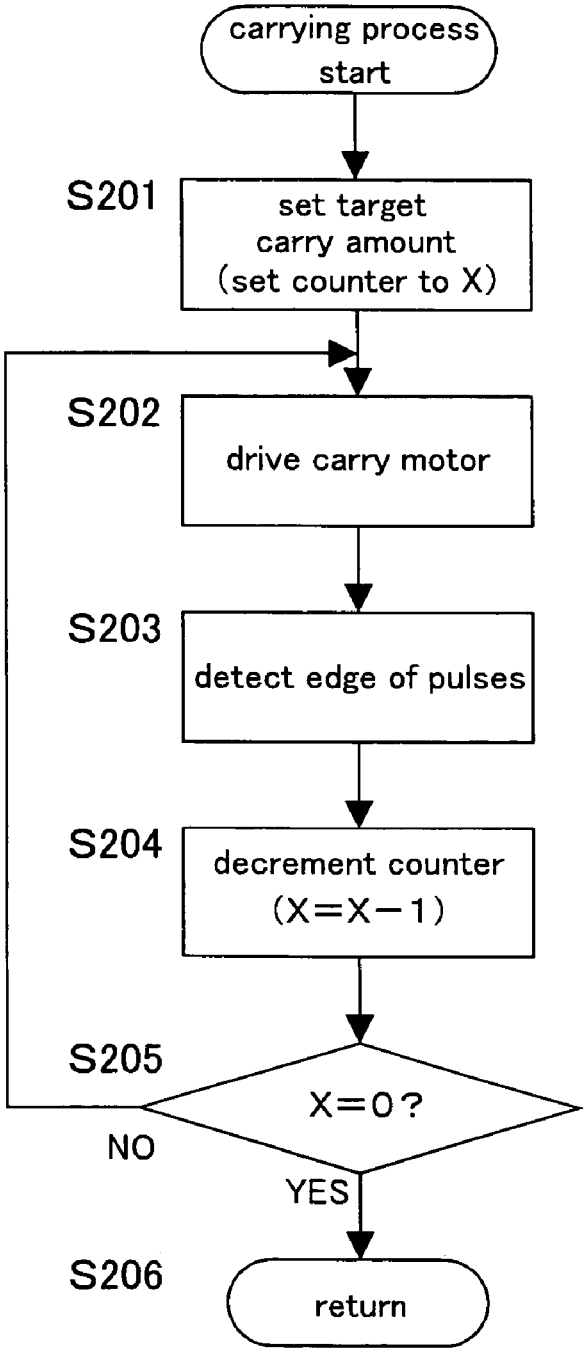
FIG. 10 is a flowchart for describing the procedure for carrying the print paper.

FIG. 10 is a flowchart for describing the procedure for carrying the print paper. The various operations of the printer 1 (or the carry unit 20) that are described below are achieved in accordance with a program stored in the memory 63 of the controller 60. Also, this program is made of codes for performing the various operations described below.

First, a target carry amount is set (S201). The target carry amount is a value for determining the drive amount of the carry unit 20, in order for the carry unit 20 to carry the print paper P by a movement amount taken as a target. The target carry amount is determined based on information about the target carry amount included in the print data received from the computer 110. The target carry amount is set by setting the value of a counter. In the present embodiment, the target carry amount is set to X, and thus the value of the counter is set to X.

Next, the carry motor 22 is driven (S202). When the carry motor 22 is driven, the carry roller 23 is rotated through gear wheels. The rotary encoder provided on the carry roller 23 is also rotated as the carry roller 23 is rotated.

Next, the edges of the pulse signal of the rotary encoder are detected (S203). That is to say, the rising edges or the falling edges of either the pulses ENC-A or ENC-B are detected. In the present embodiment, if one edge is detected, then this means that the carry roller has carried the print paper P by 1/1440 inch.

When an edge of a pulse signal of the rotary encoder has been detected, the value of the counter is decremented (S204). That is, if the value of the counter is X, then the value of the counter is set to X−1 when an edge of the pulse signal has been detected.

Next, the operations of S042 to S204 are repeated until the value of the counter becomes zero (S205). Thus, the carry motor 22 is driven until the same number of pulses as the value initially set in the counter has been detected. In this fashion, the carry unit 20 can carry the print paper P in the carrying direction by a carry amount that corresponds to the value initially set in the counter.

For example, when the print paper P is to be carried by 90/1440 inch, the value of the counter is set to 90, thereby setting the target carry amount. Then, the value of the counter is reduced each time that a rising edge or a falling edge of the pulse signal of the rotary encoder is detected. Then, when the value of the counter has reached zero, the carry unit 20 ends the carrying operation. When 90 pulse signals have been detected, then this means that the carry roller has carried the print paper P by 90/1440 inch. Consequently, if the value of the counter is set to 90 to set the target carry amount, then the result is that the carry unit 20 carries the print paper P by 90/1440 inch.

It should be noted that in the foregoing description, the rising edge or the falling edge of the pulse ENC-A or the pulse ENC-B is detected, but it is also possible to detect both edges of the pulse ENC-A and the pulse ENC-B. The cycles of the pulse ENC-A and the pulse ENC-B are equal to the slit spacing of the scale and the phases of the pulse ENC-A and the pulse ENC-B are misaligned by 90 degrees, so that detecting one of the rising edge and the falling edge of both the pulses means that the carry roller has carried the print paper by 1/5760 inch. In this case, if the value of the counter is set to 90, then the carry unit 20 carries the print paper P by 90/5760 inch. In the embodiments explained in the following, if the value of the counter is 1, then the carry unit 20 carries the print paper by 1/5769 inch.

The foregoing description is for a single carrying operation. If the carrying operation is to be performed intermittently a plurality of times, then the target carry amount is set (i.e. the counter is set) each time the carrying operation is finished, and the print paper P is carried in accordance with the target carry amount that has been set.

It should be noted that the rotary encoder 52 directly detects the rotation amount of the carry roller 23, and does not detect the carry amount of the print paper. However, when the carry roller 23 is rotated and carries the print paper P, a carry error may occur due to slippage between the carry roller 23 and the print paper P. When slippage occurs between the carry roller 23 and the print paper P in this manner, it is necessary to drive the carry roller 23 by a carry amount that is larger than the target carry amount, in order to carry the print paper P by the target carry amount. Accordingly, in the printer of the present embodiment, it is possible to correct the target carry amount and set the counter to a value that corresponds to the corrected target carry amount in order to cancel the carry error and carry the print paper P by the most suitable carry amount.

Regarding the Nozzles

Figure 11:
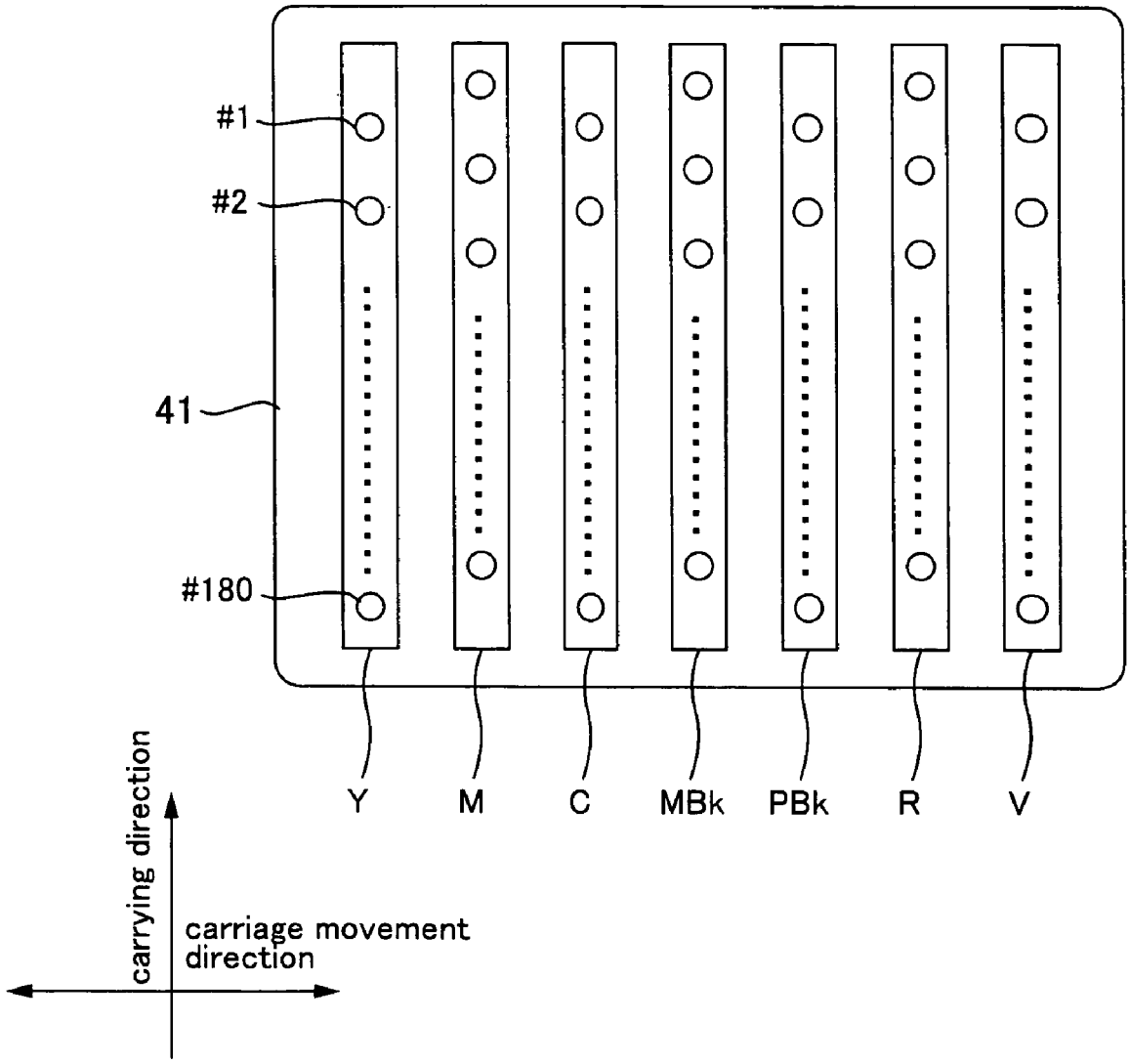
FIG. 11 is an explanatory diagram of the configuration of the lower surface of a carriage.

FIG. 11 is an explanatory diagram of the configuration of the lower surface of the carriage. The head 41 is provided on the lower surface of the carriage.

A yellow ink nozzle group Y, a magenta ink nozzle group M, a cyan ink nozzle group C, a matte black ink nozzle group MBk, a photo black ink nozzle group PBk, a red ink nozzle group R, and a violet ink nozzle group V, are formed in the lower surface of the head 41. Each nozzle group is provided with a plurality of nozzles (in this embodiment, 180), which are ejection openings for ejecting the respective inks.

The plurality of nozzles of the nozzle groups are arranged in rows at a constant spacing (nozzle pitch: k·D) in the carrying direction. Here, D is the minimum dot pitch in the carrying direction (that is, the spacing between dots formed on the print paper P at maximum resolution). Further, k is an integer of 1 or more. For example, if the nozzle pitch is 180 dpi (1/180 inch), and the dot pitch in the carrying direction is 720 dpi (1/720), then k=4.

The nozzles in each of the nozzle groups are each assigned a number (#1 to #180) that becomes smaller the more downstream the nozzle is arranged. That is, the nozzle #1 is positioned more downstream in the carrying direction than the nozzle #180. Each nozzle is provided with a piezo element as a drive element for driving the nozzle and letting it eject ink droplets.

Regarding the Driving of the Head

Figure 12:
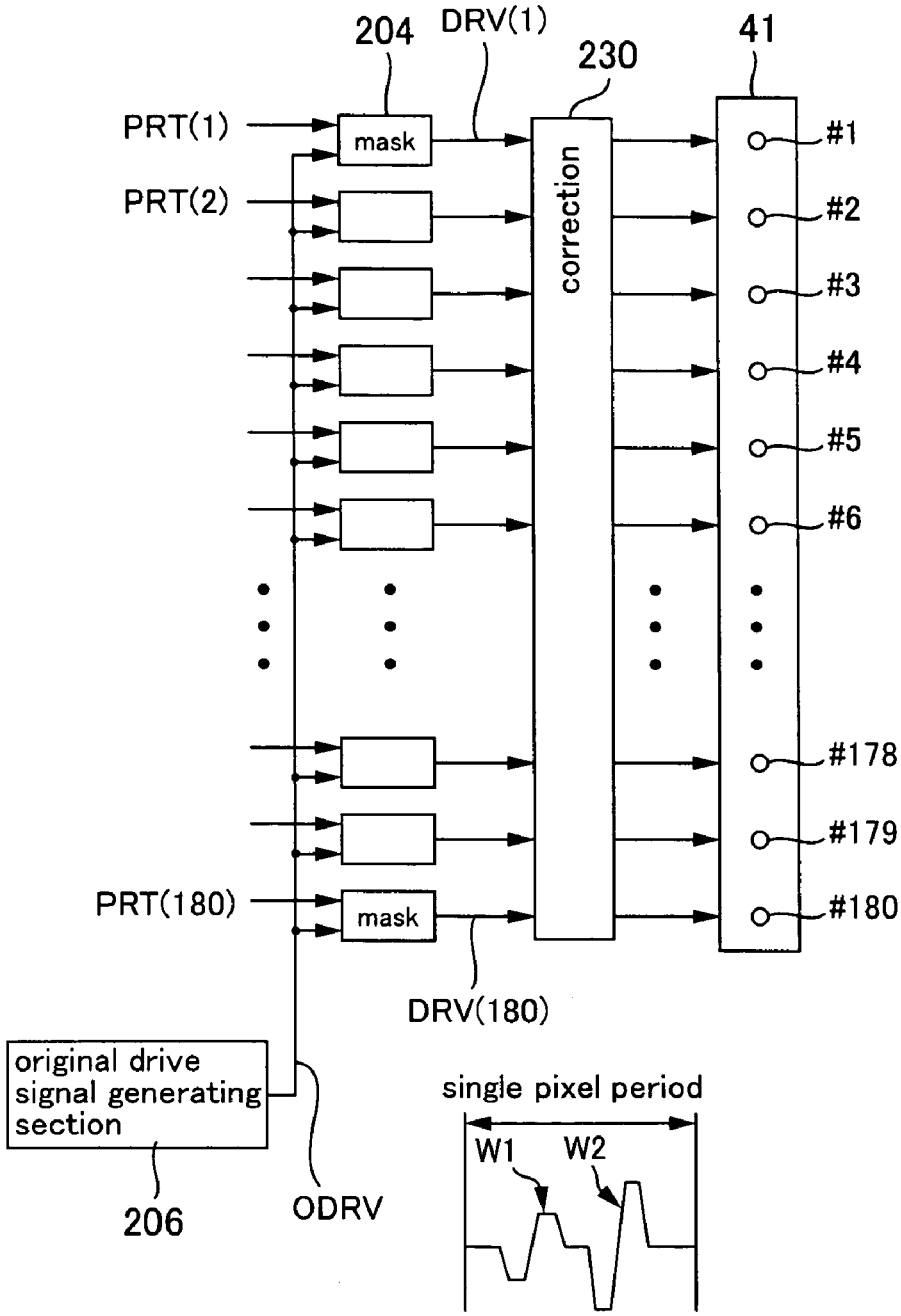
FIG. 12 is a block diagram showing the configuration of a drive signal generating section provided inside a head unit.

Next, the driving of the print head 41 is described with reference to FIG. 12. FIG. 12 is a block diagram showing the configuration of a drive signal generating section provided inside the head unit 40 (FIG. 4).

In FIG. 12, the drive signal generating section is provided with a plurality of mask circuits 204, an original drive signal generating section 206, and a drive signal correcting section 230.

The mask circuits 204 are provided in correspondence with the plurality of piezo elements PE for respectively driving the nozzles #1 to #180 of the head 41. It should be noted that in FIG. 12 the numbers in parentheses following each signal name indicate the number of the nozzle to which that signal is supplied. The original drive signal generating section 206 creates an original drive signal ODRV that is shared by the nozzles #1 to #180. The original drive signal ODRV is a signal that includes two pulses, namely a first pulse W1 and a second pulse W2, during the period of the carriage movement for a single pixel.

The drive signal correcting section 230 corrects the dot formation position in the carriage movement direction for the forward pass and the return pass of the carriage movement by slightly varying the timing of the drive signal waveform shaped by the mask circuits 204 for the return pass with respect to the forward pass. That is to say, with this correction of the timing of the drive signal waveform, misalignments in the dot formation position in the carriage movement direction between the forward pass and the return pass are corrected. The timing correction values that are entered into the drive signal correcting section 230 to achieve this correction are determined in accordance with a test pattern described further below.

It should be noted that in this embodiment, the drive generation signal section provided in the head unit 40 (FIG. 4) shown in FIG. 12 is provided for each nozzle row.

===(1) Configuration of Optical Sensor===

Regarding the Optical Sensor

Figure 13:
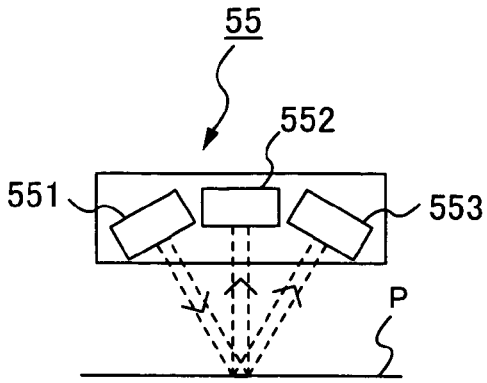
FIG. 13 is an explanatory diagram of the configuration of an optical sensor.

FIG. 13 is an explanatory diagram of the configuration of the optical sensor 55. The horizontal direction in this figure corresponds to the carriage movement direction, whereas the direction perpendicular to the paper face corresponds to the carrying direction.

This optical sensor 55 is a sensor for detecting patterns formed on a print paper. The detection of patterns with the optical sensor 55 is described further below.

The optical sensor 55 is a reflective optical sensor including a light-emitting section 551, a first light-receiving section 552 and a second light-receiving section 553. The light-emitting section 551 has, for example, a light-emitting diode and irradiates light onto the print paper P. The first light-receiving section 552 and the second light-receiving section 553 have, for example, a phototransistor, and detect the reflection light of the light that has been irradiated from the light-emitting section onto the print paper P.

The light-emitting section 551 of the optical sensor 55 irradiates light obliquely onto the print paper P. The first light-receiving section 552 of the optical sensor 55 is provided at a position perpendicular to the print paper P. Therefore, the first light-receiving section 552 receives the diffused reflection light of the light irradiated from the light-emitting section onto the print paper P. On the other hand, the second light-receiving section 553 of the optical sensor 55 is provided at a position symmetrical to the light-emitting section 551, and receives light that emanates obliquely from the print paper P. Therefore, the second light-receiving section 553 receives the regular reflection light of the light irradiated by the light-receiving section 551 onto the print paper P.

If there is a pattern with high darkness at the position of the detection spot of the optical sensor 55 (at the region on the print paper that is irradiated with light from the light-emitting section 551), then the amount of light received by the first light-receiving section 552 decreases. On the other hand, if there is a pattern with low darkness at the position of the detection spot of the optical sensor 55 (this includes the case that no pattern is formed at all), then the amount of light received by the first light-receiving section 552 increases. That is to say, the amount of light received by the first light-receiving section 552 differs depending on the darkness of the pattern, so that the controller can detect the darkness of the pattern within the detection spot (or whether there is a pattern at all) from the signal that is output from the first light-receiving section 552.

Also, if the glossiness at the position of the detection spot of the optical sensor 55 is low, then the amount of light received by the second light-receiving section 553 decreases. Conversely, if the glossiness at the position of the detection spot of the optical sensor 55 is high, then the amount of light received by the second light-receiving section 553 increases. That is to say, the amount of light received by the second light-receiving section 553 differs depending on the glossiness, so that the controller can detect the glossiness within the detection spot from the signal that is output by the second light-receiving section 553.

===(1) Regarding the Processing after the User has Selected the Image Quality Improvement Button 80===

Figure 14:
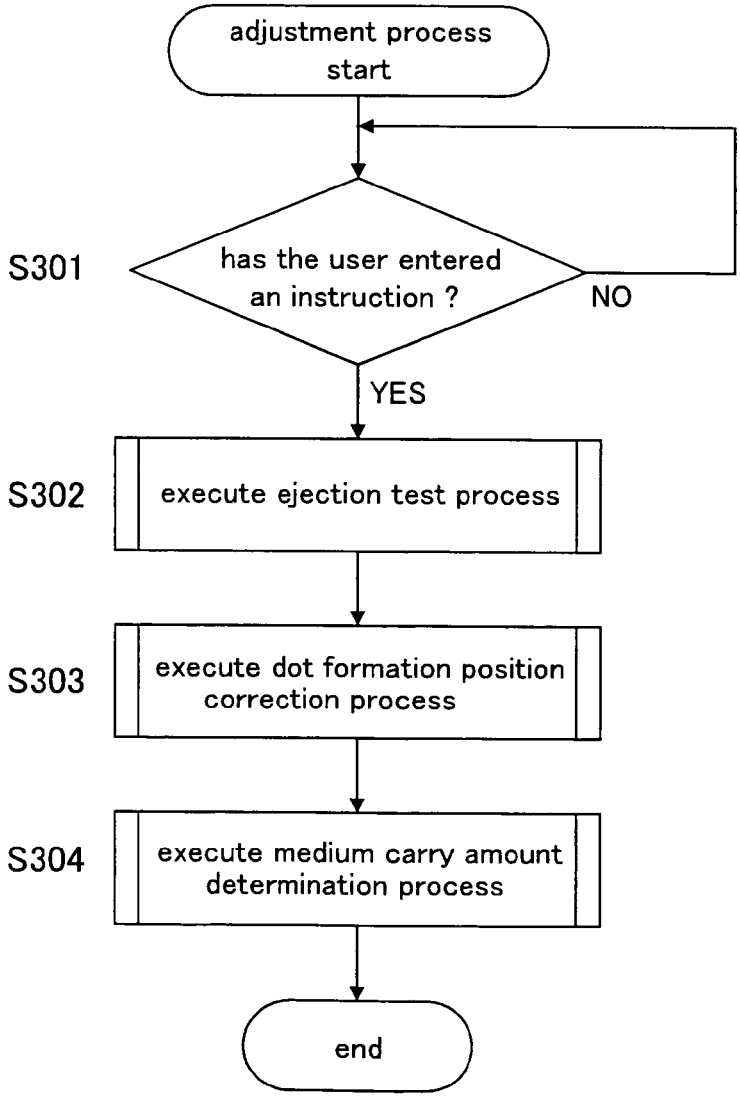
FIG. 14 is an explanatory diagram illustrating a process executed by the printer after the user has selected the image quality improvement button 80.

Next, the processing executed by the printer 1 after the user has selected the image quality improvement button 80 is described with reference to FIG. 14. FIG. 14 is an explanatory diagram illustrating the process executed by the printer 1 after the user has selected the image quality improvement button 80.

If the image quality of the printed images has dropped, the user can input an instruction to improve image quality into the printer 1. In this case, the user uses the mouse 130B to display such a user interface screen as that shown in FIG. 3 on the display device 120. Then, using the mouse 130B, the user moves the cursor displayed on the screen to the image quality improvement button 80 located below the center of the screen. If the user clicks on the mouse 130B while the cursor is on the image quality improvement button 80, then an instruction to improve image quality is entered into the printer 1 (Step S301). The procedure is on standby until an instruction to improve image quality is entered into the printer 1.

When an instruction to improve image quality has been entered into the printer 1, the procedure advances to Step S302.

In Step S302, the printer 1 carries out an ejection test to test whether or not the ink of each color is properly ejected from the nozzles. The ejection test executed in Step 302 is explained in more detail further below, with reference to FIGS. 15 to 21.

The following is an explanation of the reasons why an ejection test is carried out in step S302. Due to such factors as the adherence of ink, nozzles may sometimes become clogged, so that ink is not properly ejected from those nozzles. When there are nozzles that cannot eject ink, this may lead to a drop in image quality. This is because when there are nozzles that cannot eject ink, then the ink that should have been ejected from those nozzles will not be ejected onto the print paper. In this case, the total amount of ink that is actually ejected onto the print paper becomes lower than the total amount of ink that should have been ejected. Consequently, at the portions opposing nozzles that cannot eject ink, the print paper will be printed less densely. As a result, in the present embodiment, it is necessary to carry out an ejection test to test whether or not ink is properly ejected from the nozzles.

After the ejection test in Step S302 has been carried out, the procedure advances to Step S303.

In Step S303, the printer 1 carries out a dot formation position correction process that corrects discrepancies between dot formation positions in the carriage movement direction in the forward pass of the carriage movement and dot formation positions in the carriage movement direction in the return pass of the carriage movement. The dot formation position correction process that is executed in Step 303 is explained in more detail further below, with reference to FIGS. 22 to 24.

The following is an explanation of the reasons why a dot formation position correction process is carried out in step S303. When the printer prints on print paper, the head, which includes a plurality of nozzles, moves back and forth while ejecting ink from the nozzles toward the print paper. In the printer of the present embodiment, while the head moves back and forth, ink is ejected from the nozzles onto the print paper during both the forward pass and the return pass. Consequently, there are discrepancies in the dot formation positions of dots formed on the print paper by ink ejected from the nozzles during the forward pass and the return pass, respectively, of the reciprocating movement of the head. The reason for this is that if the head moves to the right, then also the ink that is ejected from the nozzles has a velocity pointing to the right, because the nozzles are provided on the head. Consequently, in this case, the ink that is ejected from the nozzles lands on the print paper not directly underneath the nozzles, but is offset somewhat to the right. Conversely, if the head moves to the left, then also the ink that is ejected from the nozzles has a velocity pointing to the left. Consequently, in this case, the ink that is ejected from the nozzles lands on the print paper not directly underneath the nozzles, but is offset somewhat to the left. Thus, since the ink is ejected from the nozzles while the head moves back and forth, there are discrepancies in the dot formation positions of dots formed on the print paper by the ink ejected from the nozzles.

When there are discrepancies in the dot formation positions formed on the print paper, then this may lead to a drop in image quality. The reason for this is that, as noted above, the image formed on the print paper will be slightly warped in the movement direction of the head, because, due to the movement of the head, there are discrepancies in the dot formation positions formed on the print paper. Consequently, in the present embodiment, it is necessary to correct such discrepancies in the dot formation positions.

After the dot formation position correction process in Step S303 has been carried out, the procedure advances to Step S304.

In Step S304, the printer 1 carries out a medium carry amount determination process for determining the carry amount of the print paper P during printing. The medium carry amount determination process executed in Step 304 is explained in more detail further below, with reference to FIGS. 25 to 28A and 28B.

The following is an explanation of the reasons why a medium carry amount determination process is carried out in Step S304. When the printer prints on print paper, the head, which includes a plurality of nozzles, moves, ink is ejected from the nozzles, and a band-shaped pattern (referred to as "band pattern" below) of the width of the head is formed on the print paper. Next, a carry mechanism carries the print paper in the carrying direction by a carry amount that corresponds to the width of the head. The printer then repeats the same ejection operation and carrying operation to form, on the print paper, an image in which band patterns are successively joined in the carrying direction. The carry mechanism for performing the carrying operation carries the print paper using structural elements such as motors and gears, and thus there are instances in which the carry amount is subject to error. When the carry mechanism carries the print paper by a carry amount that is larger than the carry amount set as the target (target carry amount) due to carry error, a gap occurs between the band patterns, resulting in partially lighter portions in the printed image (also referred to as "bright banding," "white banding," and "light banding"). When, due to carry error, the carry mechanism carries the print paper by a carry amount that is smaller than the target carry amount, overlapping occurs between the band-shaped patterns, resulting in partially darker portions in the printed image (also referred to as "dark banding," "black banding," and "dense banding"). The occurrence of such banding leads to a drop in the image quality. Consequently, in the present embodiment, when performing a carrying operation, the target carry amount is corrected and the medium carry amount is determined, in order to limit the impact of such carry errors.

After the medium carry amount determination process in Step S304 has been carried out, the series of processes for improving image quality is ended.

In this way, if the image quality of the printed images has dropped, the user can let the printer 1 carry out a series of processes for improving the image quality, by simply inputting an instruction to improve image quality into the printer 1. Consequently, even users who are not well versed with the printer's functionality can achieve a suitable improvement of the image quality.

The following is an explanation of a specific example of the case that a drop in image quality has occurred due to partially light portions in the printed image. In this case, a user who is not well versed in the printer's functionality will not be able to identify the reason why partially light portions occur in the printed image. That is to say, the user cannot tell whether the reason why there are partially lighter portions in the printed image is due to the fact that nozzles have clogged up, or due to the fact that the carry mechanism has carried the printed paper by a carry amount that is larger than the target carry amount so that there is a gap between the band patterns.

However, with the present embodiment, even when the user cannot identify the reason for the drop in image quality, the user can let the printer carry out a process for improving the image quality, simply by selecting the image quality improvement button 80.

Referring to FIGS. 15 to 21A, 21B and 21C, an explanation of the ejection test carried out in Step S302 is given below.

===(1) Ejection Test Process ===

The printer 1 can test whether or not the ink of each color is properly ejected from the nozzles. This ejection testing is carried out by forming predetermined test patterns by actually ejecting colored ink from the nozzles onto paper. Then, if the test result is that ejection defects, such as clogging of the nozzles, are discovered, then the nozzles are cleaned.

Figure 15:
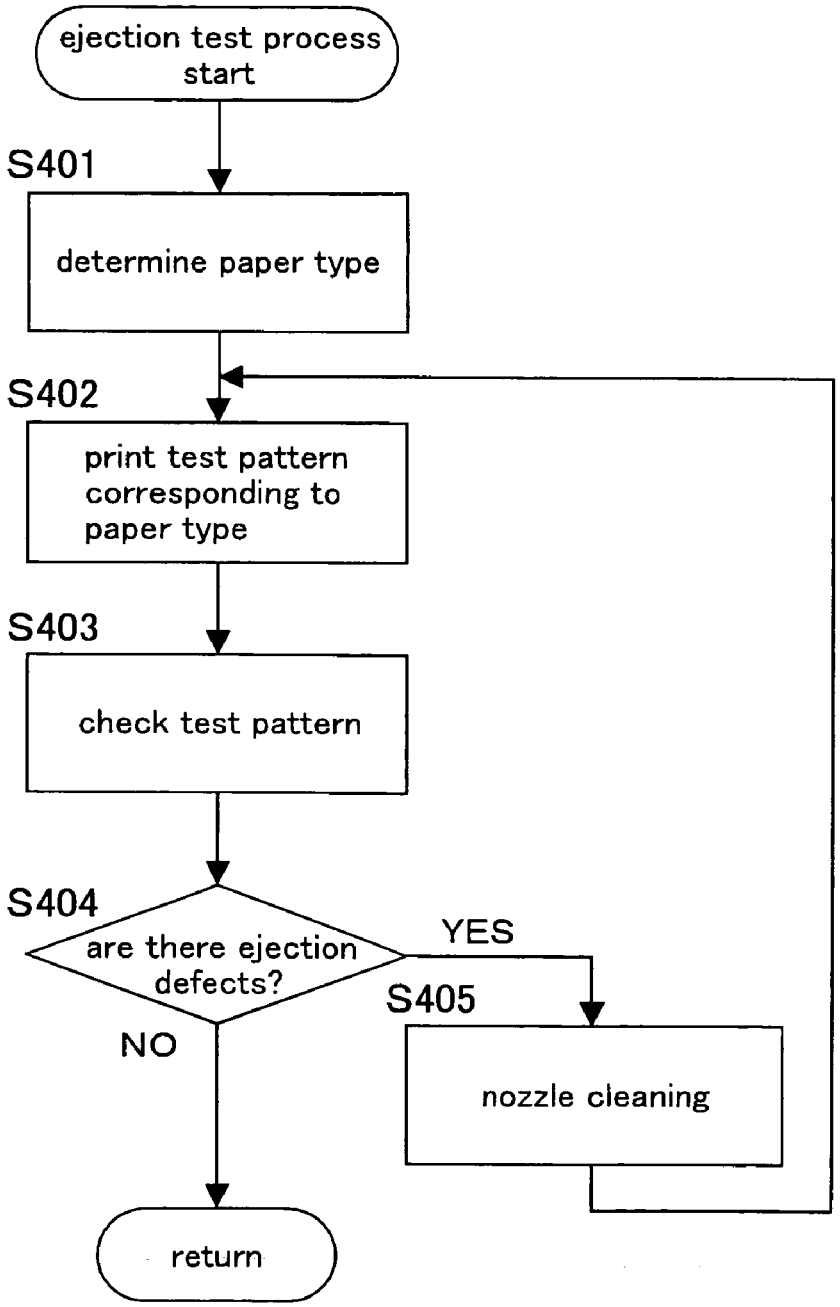
FIG. 15 illustrates an example of an ejection testing procedure.

FIG. 15 illustrates an example of an ejection testing procedure.

First, the type of paper on which the test pattern is printed is determined. In the present embodiment, it is determined whether the paper is plain paper or glossy paper (S401). It is preferable that the paper on which the test pattern is printed is of the same type as the paper used after the test. The method for determining the type of the paper is described later in further detail.

Next, a predetermined test pattern is formed by ejecting colored ink onto the medium (S402). The test pattern that is formed here is described in detail further below.

Next, the formed test pattern is inspected (S403). This inspection is performed using the optical sensor 55 mounted to the carriage. It should be noted that the inspection of the test pattern using the optical sensor 55 is discussed in greater detail later.

After checking the test pattern, it is determined, based on the detection result of the optical sensor 55, whether colored ink is present or not (S404). If it is determined here that there is an ejection defect, nozzle cleaning is performed (S405). The nozzle cleaning is described below. An example of the nozzle cleaning is the method of eliminating the clogging of the nozzles by ejecting ink from the nozzles in a state in which the ejection head has been moved to a position in which the nozzles are not in opposition to the print paper (flushing process). Another example is the method of sucking out the clogging of the nozzles by applying a negative pressure inside the nozzles. On the other hand, if no ejection defects are discovered, then the ejection test process is terminated.

Method for Discriminating the Paper Type

The following two methods for discriminating the paper type are conceivable. However, the method for discriminating the paper type is not limited to these, and other methods are possible as well. That is to say, it is sufficient if the printer obtains information about the paper type when printing the test pattern on the paper.

The Method of Obtaining the Paper Type Information from an External Device

As described for the settings of the printer driver noted above, the user can select the print paper to be used for printing from a settings screen of the printer driver. If the user has selected plain paper in the settings of the printer driver, the type of paper that is ordinarily supplied by the printer is plain paper. If the user has selected glossy paper in the settings of the printer driver, the type of paper that is ordinarily supplied by the printer is glossy paper. Then, the information about the type of paper set in the printer driver (paper type information) is sent together with the print data when the print data is sent from the computer to the printer. The printer can then obtain the paper type information from the information that has been sent from the computer.

The Method of Discriminating the Paper Type with the Optical Sensor

Different paper types have different reflectance. For example, when irradiating the same amount of light onto the surface of plain paper and of glossy paper, the amount of reflected light will differ. Therefore, by carrying the paper to the position of the optical sensor 55, the printer can discriminate the paper type based on the amount of light that is reflected from the paper, using the optical sensor 55. In this case, the printer stores in advance a reference table correlating output values of the optical sensor 55 with paper types in a memory, looks up the output value of the optical sensor 55 in the reference table, and thus discriminates the paper type.

Method for Forming the Color Ink Test Pattern

Regarding the Test Pattern

Figure 16:
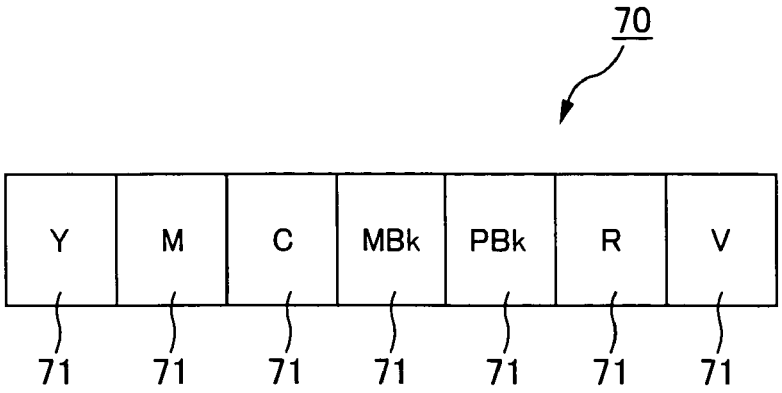
FIG. 16 is a conceptual diagram of an overall test pattern group used for the ejection test of the nozzles ejecting colored ink.
Figure 17A:
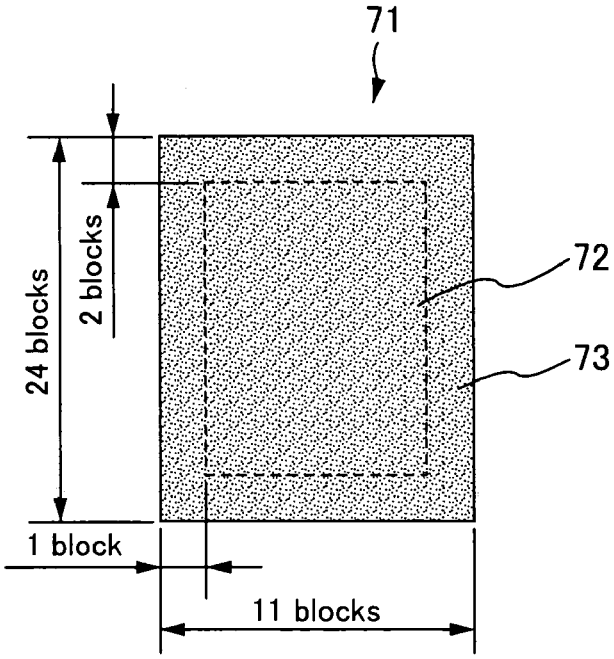
FIG. 17A is an explanatory diagram of one of the test patterns making up the test pattern group.
Figure 17B:
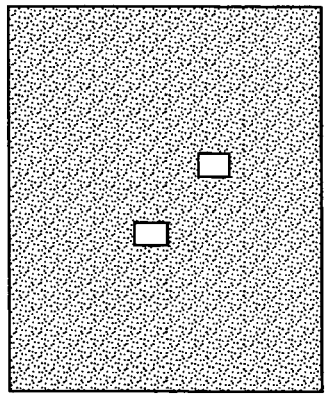
FIG. 17B is an example of a test pattern when there are nozzles that do not eject colored ink.
Figure 18:
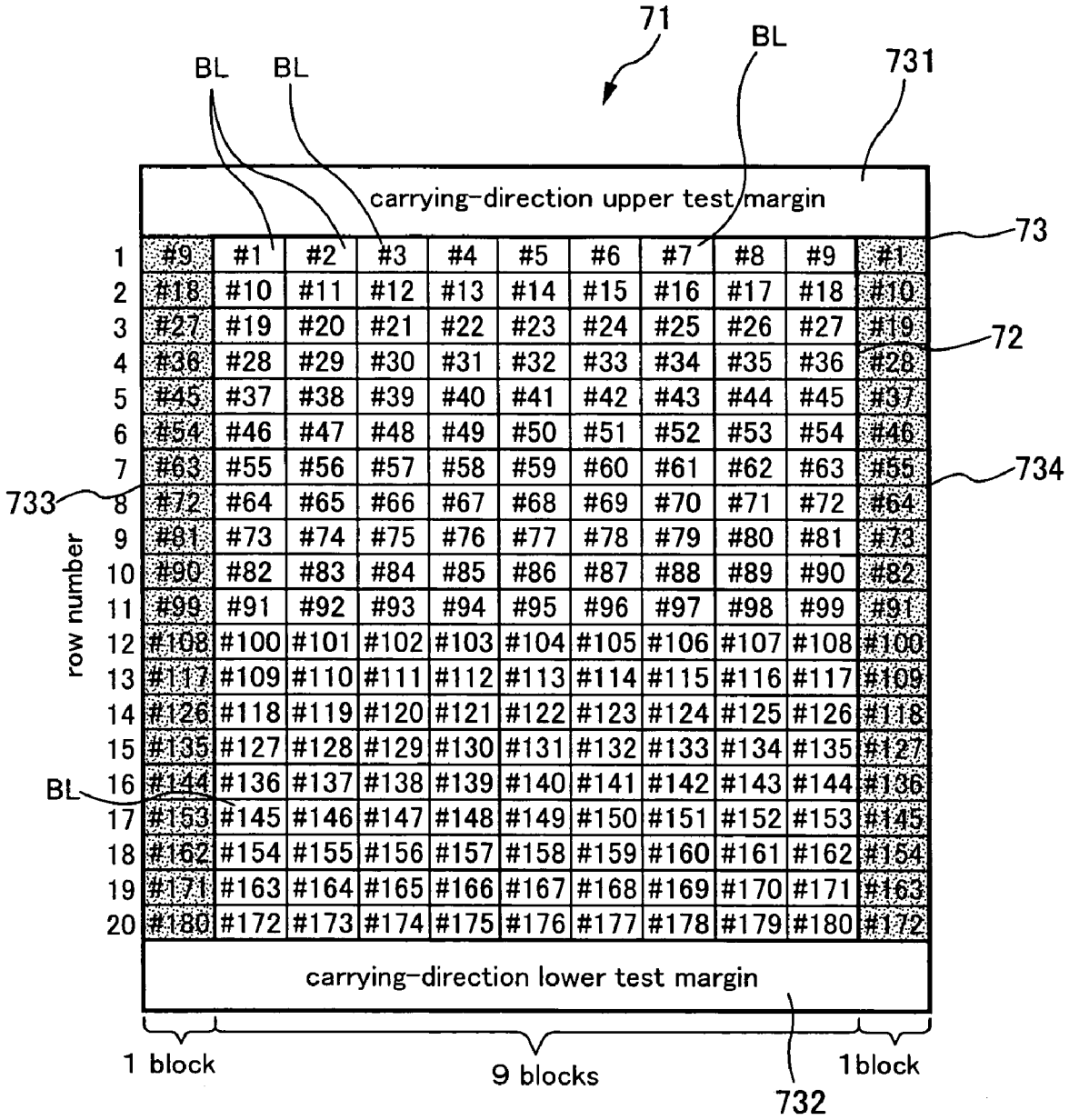
FIG. 18 is an explanatory diagram of the configuration of a test pattern for colored ink.
Figure 19:
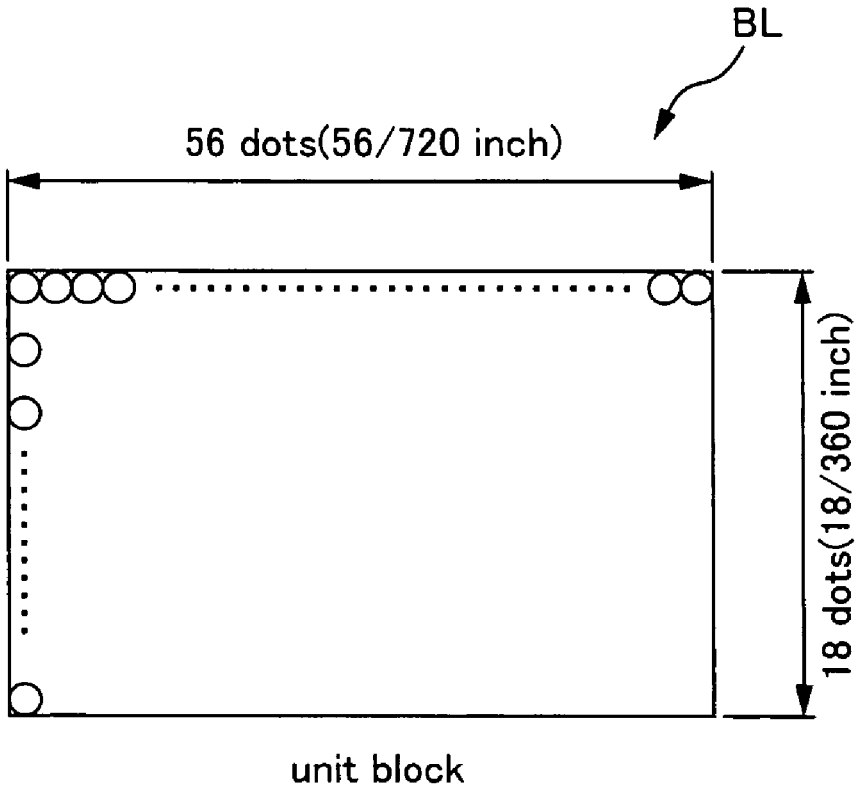
FIG. 19 is an explanatory diagram of a block pattern BL making up the test pattern.

FIG. 16 is a conceptual diagram showing an overall test pattern group 70 used for the ejection test of the nozzles ejecting colored ink. FIG. 17A is an explanatory diagram of one of the test patterns 71 making up the test pattern group 70. FIG. 17B is an example of a test pattern when there are nozzles that do not eject colored ink. FIG. 18 is an explanatory diagram of the configuration of a colored ink test pattern 71. FIG. 19 is an explanatory diagram of a block pattern BL making up the test pattern 71.

The test pattern group 70 is made of a plurality of test patterns 71. These test patterns 71 are formed adjacent to one another in the carriage movement direction. Each test pattern is made of a particular ink color. For example, the test pattern 71 labeled "Y" in FIG. 16 is made of yellow ink only. That is, the test pattern 71 labeled "Y" in this drawing is formed by the nozzles ejecting yellow ink. As will be discussed later, this test pattern 71 is used for testing ejection of the nozzles ejecting yellow ink. The test patterns 71 for the other colors have an identical structure.

Each test pattern 71 is made of a tested region 72 and a non-tested region 73. The tested region 72 is made of nine block patterns BL in the carriage movement direction and 20 block patterns BL in the carrying direction, amounting to a total of 180 block patterns BL. As explained below, every single block pattern BL corresponds to a single nozzle. Thus, the 180 block patterns BL of the tested region 72 are patterns for inspecting the 180 nozzles. The non-tested region 73 is formed so as to enclose the tested region 72. The non-tested region 73 is made of a carrying-direction upper test margin 731, a carrying-direction lower test margin 732, a carriage-movement-direction left test margin 733 and a carriage-movement-direction right test margin 734. These test margins are provided in order to prevent erroneous detection when the optical sensor 55 detects the block patterns BL within the tested region 72. That is to say, if there were no non-tested region around the tested region 72, then there will be differences in the detection results between block patterns formed on the inner section of the tested region and enclosed by other block patterns, and block patterns formed on the outer edge of the tested region and not enclosed by other block patterns, and therefore, block patterns are also formed to the outer side of the tested region 72.

Each block pattern BL is a rectangular pattern made of 56 dots at a 1/720 inch spacing in the carriage movement direction and 18 dots at a 1/360 inch spacing in the carrying direction. The dots in each block pattern BL are formed by ink droplets that are ejected from the same nozzle. For example, the block pattern BL labeled "#1" in FIG. 18 is formed by ink droplets that are ejected from the nozzle #1 only. Thus, each block pattern BL corresponds to a nozzle forming that block pattern BL. If there are ink-non-ejecting nozzles (nozzles that do not eject ink), then, as shown in FIG. 17B, rectangular, blank patterns occur in the test pattern 71. That is, by detecting whether or not there are blank patterns, it is possible to test whether or not there are ink-non-ejecting nozzles. Moreover, by detecting the position of those blank patterns, it is possible to specify the ink-non-ejecting nozzles.

Method for Forming Test Pattern

Figure 20:
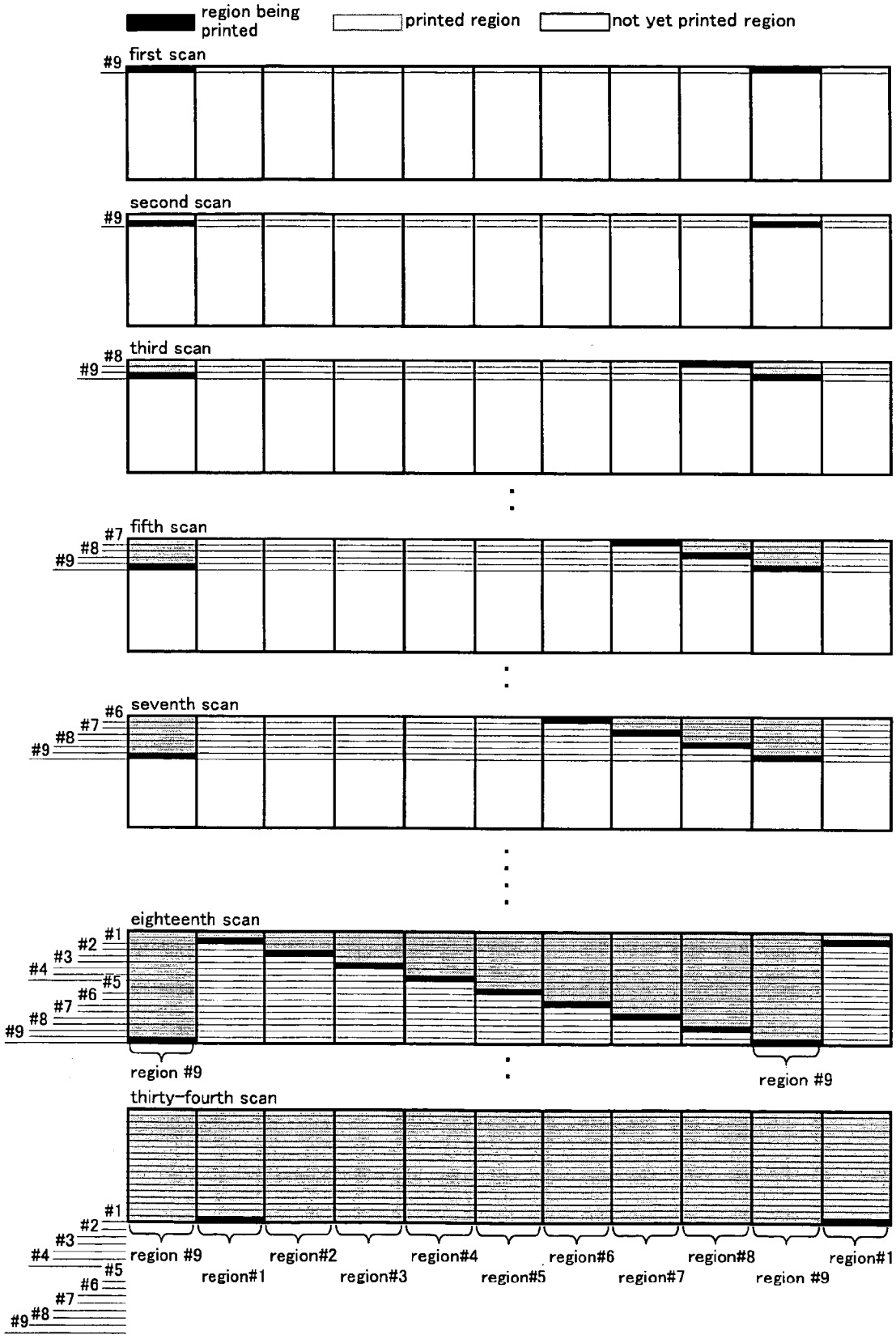
FIG. 20 is an explanatory diagram of a method for forming the eleven block patterns of the first row of the test pattern.

FIG. 20 is an explanatory diagram of a method for forming the eleven block patterns of the first row of the test pattern 71. The diagram shows the dot rows (the rows of 56 dots lined up in the carriage movement direction of FIG. 19) that are formed by a single dot formation process (S103: see FIG. 9). Also, the numbers on the left side of the diagram indicate the nozzle numbers, and the positions of the nozzle numbers indicate the positions of the nozzles with respect to the block pattern BL.

First, the paper is fed until the leading end position on the carrying direction downstream side of the tested region 72 is in opposition to nozzle #9. Then, the printer 1 executes a first dot formation process, and when the carriage 31 has arrived at a predetermined position, ink is ejected intermittently from nozzle #9. Thus, a dot row is formed at a downstream-side position of the block pattern corresponding to nozzle #9.

Next, the printer carries the paper by half the nozzle pitch (1/360 inch) using the carry unit. Then, the printer executes a second dot formation process, and when the carriage has arrived at a predetermined position, ink is ejected intermittently from nozzle #9. Thus, a dot row is formed adjacent on the carrying direction upstream side to the dot row formed in the first dot formation process.

Next, the printer carries the paper by half the nozzle pitch using the carry unit. Then, the printer executes a third dot formation process. In the third dot formation process, the printer intermittently ejects ink from nozzle #9 and nozzle #8. A dot row is formed by the ink ejected from nozzle #9, adjacent on the carrying direction upstream side to the dot row formed in the second dot formation process. Also, a dot row is formed by the ink that is ejected from nozzle #8 at a downstream-side position of the block pattern BL corresponding to nozzle #8.

Next, the printer carries the paper by half the nozzle pitch using the carry unit. Then, the printer executes a fourth dot formation process. Also in the fourth dot formation process, the printer intermittently ejects ink from nozzle #9 and nozzle #8, forming dot rows adjacent on the carrying direction upstream side to the dot rows formed in the third dot formation process. In this manner, dot formation and carrying are executed to twice form dot rows, while per every two dot formation processes, the number of nozzles ejecting ink is increased by one from the carrying direction upstream side.

In the 18th dot formation process, the block pattern corresponding to nozzle #9 is completed. Thus, in the 19th dot formation process, the ejection of ink from nozzle #9 is stopped. Thereafter, per every two dot formation processes, the ejection of ink is stopped one nozzle at a time in order from the nozzle positioned on the carrying direction upstream side.

Then, in the 34th dot formation process, the eleven block patterns of the first row of the tested region 72 are completed.

The above description is for a method for forming the eleven block patterns of the first row, which is positioned on the most downstream side in the carrying direction of the tested region 72, but the eleven block patterns of the other rows are formed at the same time that the eleven block patterns of the first row are formed. That is, the 180 nozzles from nozzle #1 to nozzle #180 are grouped into 20 nozzle groups of nine consecutive nozzles per group, and eleven block patterns are formed by each nozzle group using the same procedure. For example, when a dot row is being formed by nozzle #9, ink is being ejected at identical timing from nozzle #9N (where N is an integer).

The spacing between adjacent block patterns is the same as the dot spacing of the dot rows constituting these block patterns. Therefore, if there are no non-ejecting nozzles, the darkness inside the test pattern 71 becomes uniform, and it is difficult to discern the individual block patterns with the bare eye from the test pattern 71.

Regarding the Inspection of the Color Ink Test Pattern

Figure 21A:
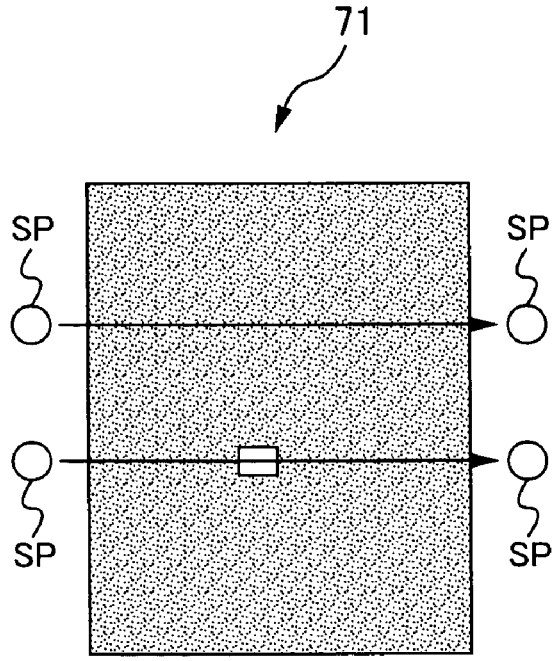
FIG. 21A is an explanatory diagram illustrating the inspection of the colored ink test pattern.
Figure 21B:
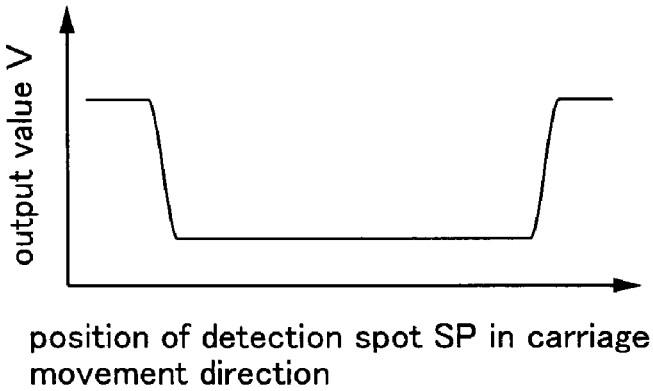
FIG. 21B is an explanatory diagram of the test result of the optical sensor for the case that there is no non-ejecting nozzle.
Figure 21C:
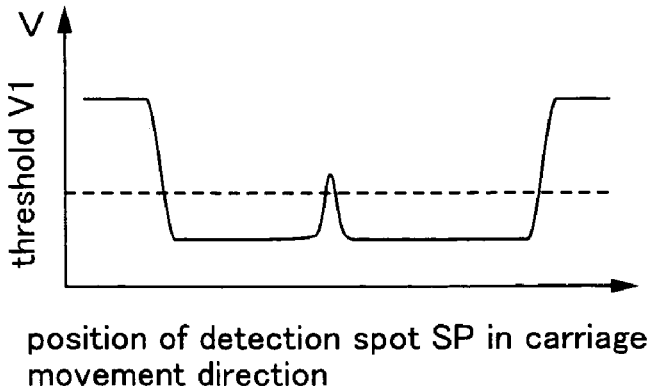
FIG. 21C is an explanatory diagram of the test result of the optical sensor for the case that there is a non-ejecting nozzle.

FIG. 21A is an explanatory diagram illustrating the inspection of the colored ink test pattern 71. FIG. 21B is an explanatory diagram of the test result of the optical sensor 55 for the case that there is no non-ejecting nozzle. FIG. 21C is an explanatory diagram of the test result of the optical sensor 55 for the case that there is a non-ejecting nozzle. The circular marks SP in the figure denote the detection spots of the optical sensor 55.

The inspection of the color ink test pattern 71 is based on the output of the first light-receiving section 55 of the optical sensor 55. That is to say, the inspection of the color ink test pattern is based on the amount of diffused reflection light.

The first light-receiving section 552 of the optical sensor 55 outputs a higher voltage the greater the amount of light that is received, and outputs a lower voltage the smaller the amount of light that is received.

Since the inspection is performed with the diffused reflection light measured using the first light-receiving section 552 of the optical sensor 55, if there is a pattern formed by colored ink inside the detection spot SP, the amount of light received by the first light-receiving section 552 is reduced, and the output voltage of the optical sensor 55 becomes low. On the other hand, if there is no pattern formed by colored ink inside the detection spot SP, the amount of light received by the first light-receiving section 552 increases, and the output voltage of the optical sensor 55 becomes high.

When the controller inspects the test pattern, the detection spot SP moves in the carriage movement direction and traverses the test pattern 71. If there is no blank pattern in the trajectory of the detection spot SP, the optical sensor 55 outputs a low voltage while the detection spot SP traverses the detection pattern 71. That is to say, if there is no non-ejecting nozzle, the optical sensor 55 outputs a low voltage while the detection spot SP traverses the detection pattern 71 (see FIG. 21B).

On the other hand, if there is a blank pattern in the trajectory of the detection spot SP, the optical sensor 55 outputs a relatively high voltage when the detection spot SP is positioned above the blank pattern. That is to say, if there is a non-ejecting nozzle, the optical sensor 55 outputs a relatively high voltage when the detection spot is positioned above the block pattern BL corresponding to that non-ejecting nozzle (see FIG. 21C).

Consequently, if a predetermined threshold value V1 is set in advance, and the controller detects whether or not the output voltage of the optical sensor 55 exceeds that threshold value V1 during the inspection of the test pattern 71 (while the detection spot SP traverses the test pattern 71), then the presence of non-ejecting nozzles can be detected. It should be noted that the information regarding the threshold value V1 is stored in advance in the memory. Moreover, if it is counted how many times the output voltage of the optical sensor 55 has exceeded the threshold value V1, then it can be detected how many non-ejecting nozzles there are.

Furthermore, based on the position of the detection spot SP at the time that the output voltage of the optical sensor 55 exceeds V1, the controller can identify the non-ejecting nozzles. It should be noted that the position of the detection spot SP in the carriage movement direction can be detected from the output of the linear encoder 51. Also, the position of the detection spot SP in the carrying direction can be detected from the output of the rotary encoder 52. For example, based on the detection result of the optical sensor 55 as shown in FIG. 21C, the controller can identify that the non-ejecting nozzle is nozzle #112. It should be noted that in this case, information correlating the position of the block patterns BL and the nozzle number is stored in advance in the memory.

===(1) Dot Formation Position Correction Process===

Figure 22:
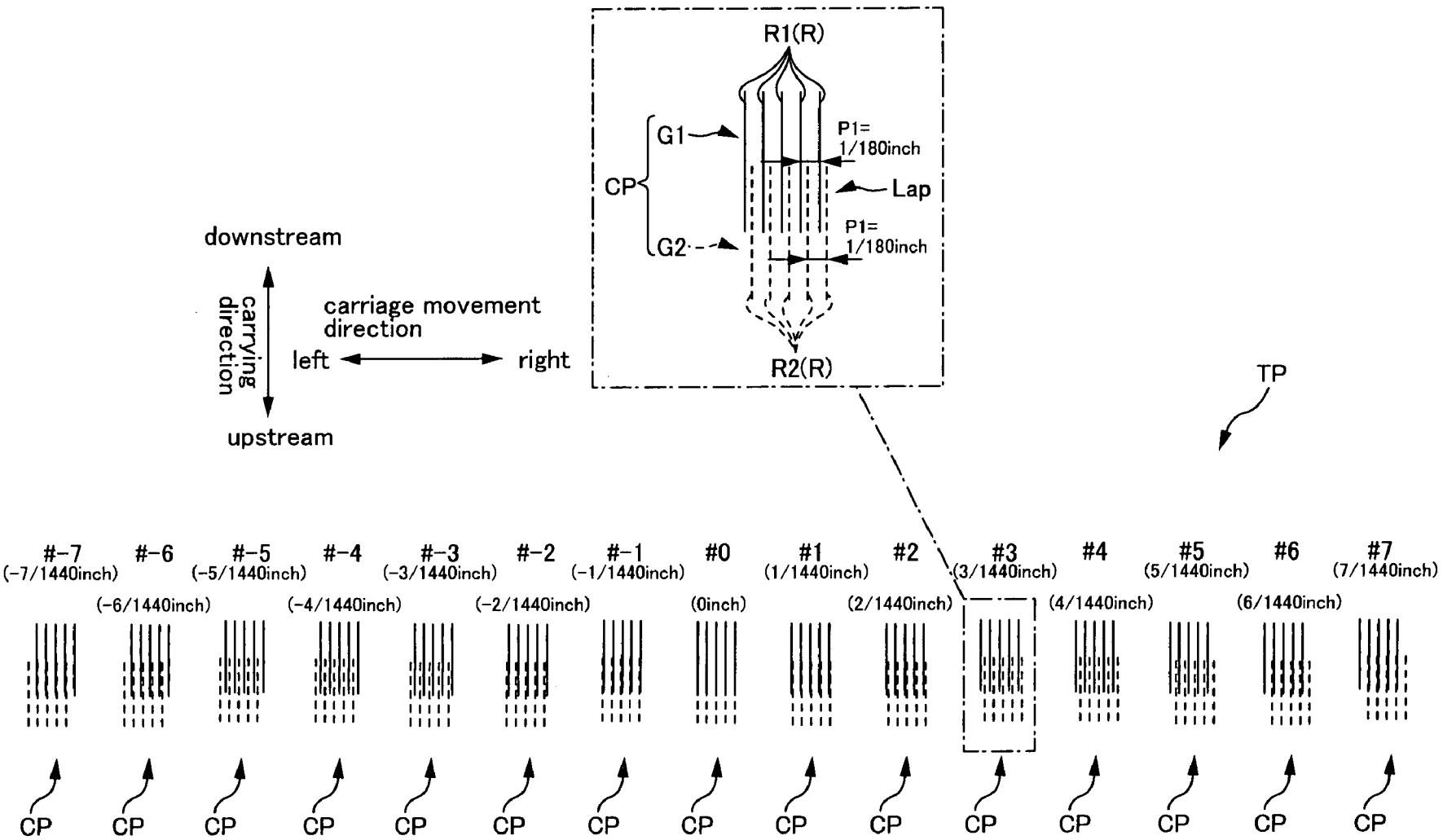
FIG. 22 is an explanatory diagram of a test pattern for correcting the dot formation positions.
Figure 23:
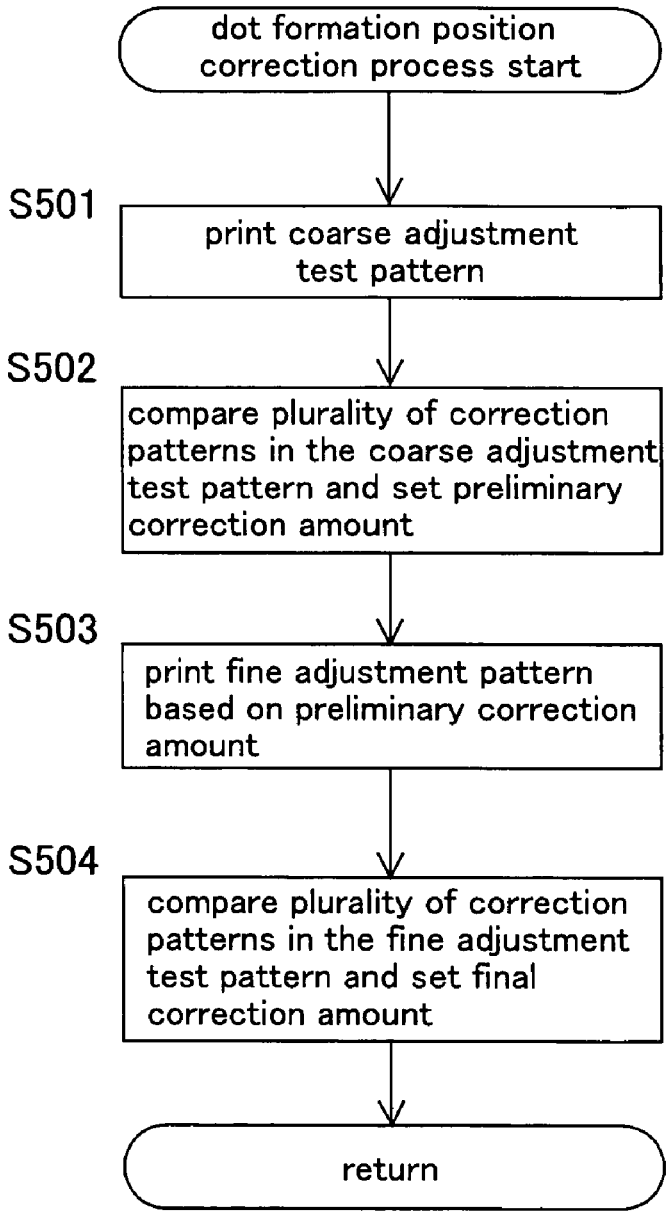
FIG. 23 is a flowchart of the dot formation position correction process.
Figure 24:
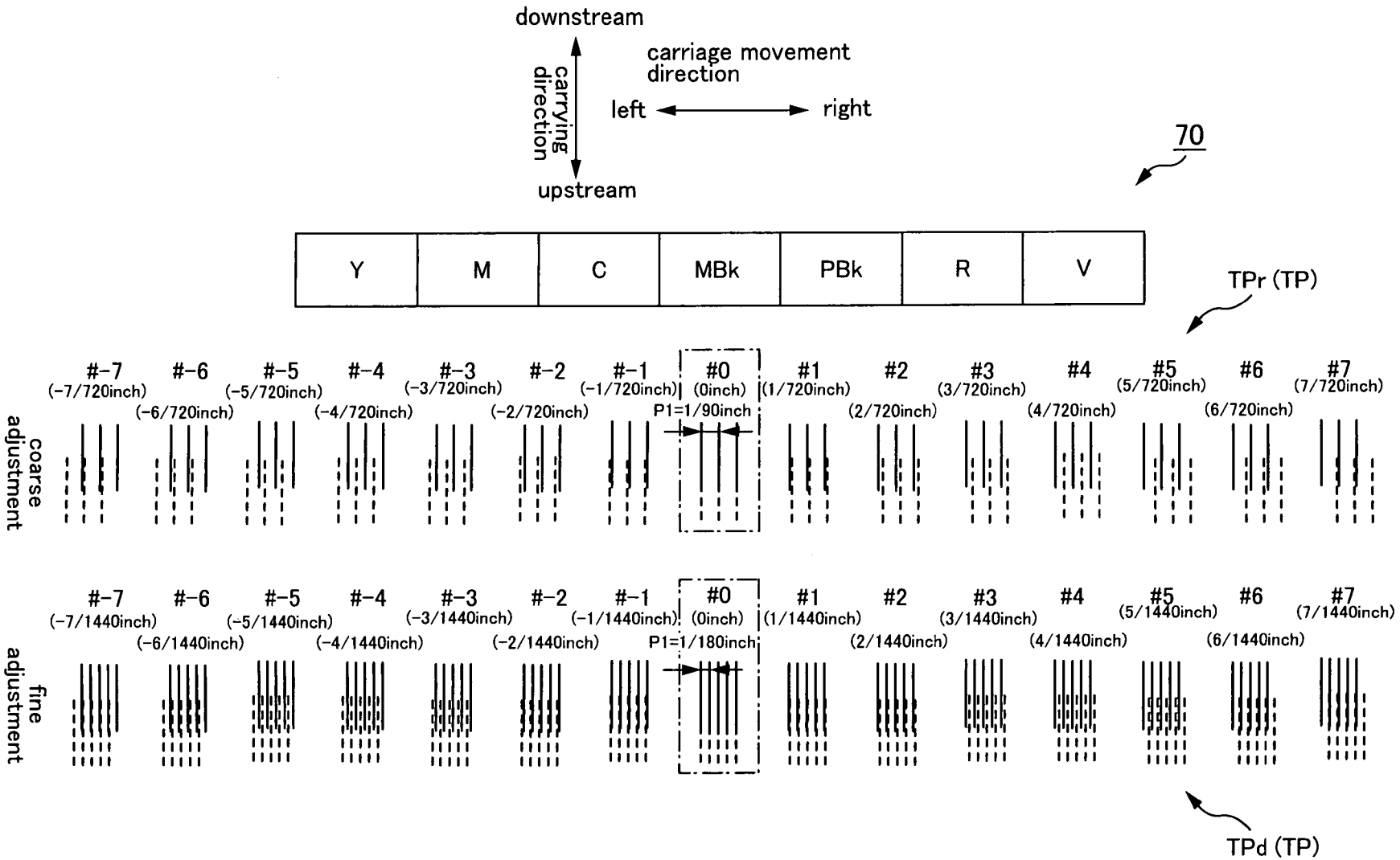
FIG. 24 is an explanatory diagram of a test pattern for correcting dot formation positions of the present embodiment.

Referring to FIGS. 22 to 24 in order, an explanation of the dot formation position correction process performed in Step S303 is described below.

Test Pattern for Correcting Discrepancies in the Dot Formation Position in the Carriage Movement Direction With the goal of correcting discrepancies between the dot formation positions in the carriage movement direction in the forward pass of the carriage movement and the dot formation positions in the carriage movement direction in the return pass thereof, the printer prints a test pattern TP on the print paper by ejecting ink from the nozzles.

FIG. 22 is a conceptual diagram showing this test pattern. It should be noted that this test pattern TP is printed for each nozzle row, that is, the correction of the discrepancies of the dot formation positions is performed for each nozzle row individually. Here, an example is explained in which the discrepancies in the dot formation positions of the black nozzle row are corrected, but the correction for the nozzle rows of the other colors is the same.

As shown in FIG. 22, the test pattern TP comprises for example 15 correction patterns CP, arranged along the carriage movement direction. The numbers #1 to #7 and #−1 to #−7 printed above the correction patterns CP each indicate a correction amount corresponding to that correction pattern CP. In the figure, the corresponding correction amounts are indicated below those numbers.

Different values are correlated to each of the correction amounts for the respective correction patterns CP, and depending on the correction amount, the relative positions in the carriage movement direction of a first dot row group G1 and a second dot row group G2 (which are explained below) are successively shifted by a predetermined difference for each correction pattern CP. For example, in the center of the test pattern TP, a correction pattern CP (#0) with a correction amount of 0 inches is printed, and the correction patterns CP are printed such that with increasing distance to the left and right in the carriage movement direction, the correction amounts of the correction patterns CP (#1) to CP (#7) and CP (#−1) to CP (#−7) each change by a predetermined difference of, for example, 1/1440 inch. Note that the correction patterns CP (#1) to CP (#7) to the right and the correction patterns CP (#−1) to CP (#−7) to the left of the correction pattern CP (#0) have their correction amounts changed in opposite directions.

Then, from these correction patterns CP, the correction pattern CP is selected for which the relative positions of the first dot row group G1 and the second dot row group G2 are best aligned, and based on the correction value corresponding to this selected correction pattern CP, a timing correction value corresponding to the above is input into the drive signal correcting section 230 as the correction value for bidirectional printing. It should be noted that in the example in the figure, this "best aligned correction pattern" is the correction pattern CP (#0), and in this case, a timing correction value corresponding to 0 inches is entered into the drive signal correcting section 230.

As shown by partial magnification in FIG. 22, each correction pattern CP includes a first dot row group G1 having five dot rows R1 formed at a predetermined pitch P1 of for example 1/180 inch in the carriage movement direction and a second dot row group G2 having a plurality of dot rows R2 formed at the same pitch as the dot rows R1 of the first dot row group G1. The second dot row group G2 is arranged to the upstream side of the first dot row group G1, with respect to the carrying direction. Note that the dot rows R are made of a plurality of dots that are formed at a nozzle pitch k·D of 1/180 inch in the carrying direction, and these dots are formed by ejecting ink simultaneously from the nozzles of the black nozzle row.

Here, as shown by partial magnification in the figure, a portion on the upstream side, in the carrying direction, of the first dot row group G1 overlaps with a portion on the downstream side, in the carrying direction, of the second dot row group G2, thus forming an overlapping portion Lap.

By confirming the amount of the shift between the dot rows R1 of the first dot row group G1 and the dot rows R2 of the second dot row group G2 in this overlapping portion Lap, the "best aligned correction pattern CP" can be selected from the 15 correction patterns CP.

The evaluation of the amount of the shift between the dot rows R1 and R2 in the overlapping portion Lap is performed by measuring the darkness of the overlapping portion Lap with the optical sensor 55.

That is to say, the "best aligned correction pattern CP" can be identified by selecting the correction pattern CP whose darkness, as measured by the optical sensor 55, is the lightest.

The following is the reason why the amount of the shift can be evaluated from the darkness of the overlapping pattern Lap. In the correction pattern CP (#4) in which the shift amount is largest, the dot rows R1 and R2 are each positioned in the middle between the opposing dot rows R. Therefore, the proportion of the area of the blank portion between the dot rows R1 and R2 within the spot of the optical sensor 55 is small, and thus also the intensity of the spot's reflection light is weak, so that the overlapping portion Lap is measured to be dark. On the other hand, in the correction pattern CP (#0) in which the shift amount is smallest, the positions of the dot rows R1 and R2 are aligned with respect to the carriage movement direction, as shown in FIG. 22. Therefore, the proportion of the area of the blank portion between the dot rows R1 and R2 within the spot of the optical sensor 55 is large, and thus also the intensity of the spot's reflection light is strong, so that the darkness of the overlapping portion Lap is measured to be light.

The printing of this test pattern TP is performed by forming the first dot row group G1 by ejection of ink from the black nozzle row in the forward pass of the carriage movement, and then forming the second dot row group G2 by ejection of ink also from the black nozzle row in the return pass after feeding the print paper forward in the carrying direction. It should be noted that when forming the second dot row group G2 in the return pass, the ejection timing of the ink for the return pass is changed in accordance with the correction amount corresponding to the respective correction pattern CP. Thus, each of the correction patterns CP is printed such that the relative positions, with respect to the carriage movement direction, of the first dot row group G1 and the second dot row group G2 are shifted by a predetermined difference among each of the patterns.

Procedure for Determining the Correction Amount Using the Test Pattern

A procedure for determining the correction amount using this test pattern TP is explained with reference to the flowchart in FIG. 23, and the conceptual diagram of the test pattern of a reference example shown in FIG. 24.

As shown in FIG. 23, the correction amount is determined in two stages, namely a coarse adjustment and a fine adjustment stage. The reason for this is that the correction amount can be ascertained in shorter time and with greater precision by first specifying the correction value coarsely with large values for the predetermined differences and then specifying it precisely with small values for the predetermined differences. Therefore, as shown in FIG. 24, there are two types of test patterns TP, one for coarse adjustment and one for fine adjustment.

To explain the procedure in more detail, first, in the coarse adjustment of the first stage, the printer 1 prints a test pattern TPr for coarse adjustment below the test pattern group 70 used for the nozzle ejection test, setting the predetermined difference of the correction amounts to a large value, as shown in FIG. 24 (S501). Then, the printer 1 compares the plurality of correction patterns CP of this coarse adjustment test pattern TPr, selects the "best aligned correction pattern CP", and determines this correction amount as the preliminary correction amount (S502). In the example in the figure, the 15 correction patterns CP are formed while changing the correction amounts by the predetermined difference of 1/720 inch each. Then, the correction pattern CP (#0) is selected as the "best aligned correction pattern CP", so that the preliminary correction amount is 0 inches.

Next, in the fine adjustment of the second stage, the printer 1 prints a fine adjustment test pattern TPd below the coarse adjustment test pattern TPr, setting the predetermined difference of the correction amounts to a small value (S503). Here, the plurality of correction amounts for this test pattern TPd are set such that the median value of these correction amounts is the preliminary correction amount determined by the coarse adjustment. Then, the printer 1 compares the plurality of correction patterns CP of this fine adjustment test pattern TPd, selects the "best aligned correction pattern CP", and determines this correction amount as the final correction amount (S504). In the example in the figure, the 15 correction patterns CP are formed while changing the correction amounts by the predetermined difference of 1/1440 inch each. Then, the correction pattern CP (#0) is selected as the "best aligned correction pattern CP", so that the final correction amount is 0 inches.

The printer 1 then enters a timing correction value corresponding to this final correction amount into the drive signal correcting section 230.

Referring to FIGS. 25 to 28A and 28B, an explanation of the medium carry amount determination process carried out in Step S304 is described below.

===(1) Medium Carry Amount Determination Process===

Figure 25:
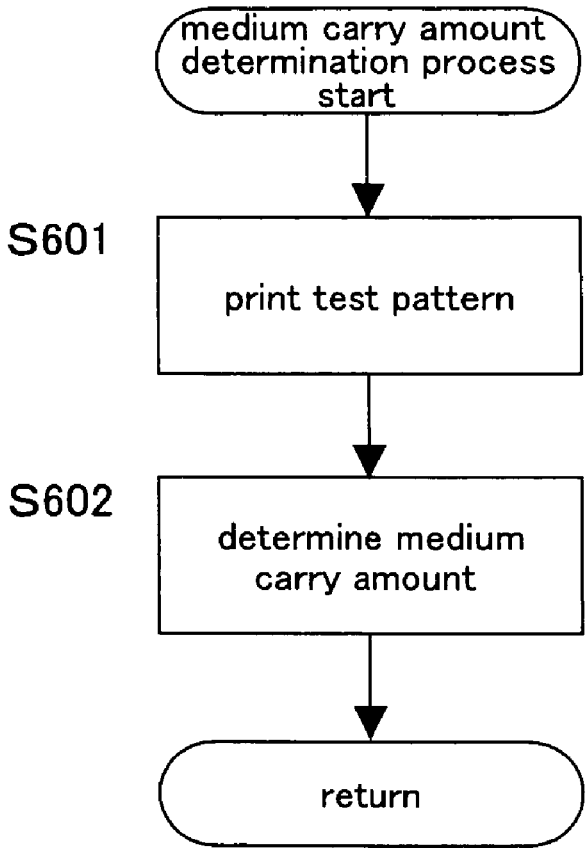
FIG. 25 is a flowchart illustrating a procedure for determining the medium carry amount.

FIG. 25 is a flowchart illustrating the procedure for determining the medium carry amount. The various operations of the printer that are described below are achieved in accordance with a program stored on the memory 63 in the printer. Also, this program is constituted by codes for performing the various operations described below.

The printer prints a test pattern for carry amount correction (S601). After receiving the command signal, the printer retrieves information about the test pattern for carry amount correction among the test patterns in the memory 63. Then, the printer prints the test pattern on the print paper P according to the information on the test pattern for carry amount correction. The method for printing the test pattern for carry amount correction is explained in more detail later with reference to FIG. 26.

After the test pattern for carry amount correction has been printed, the medium carry amount is determined from the result of detecting the test pattern for carry amount correction with the optical sensor 55 (S602). The method for detecting the test pattern for carry amount correction with the optical sensor 55 is explained in more detail later with reference to FIG. 28. After the medium carry amount has been determined in Step S602, the printer 1 terminates the series of processes for improving image quality.

Method for Printing the Test Pattern for Carry Amount Correction

Figure 26:
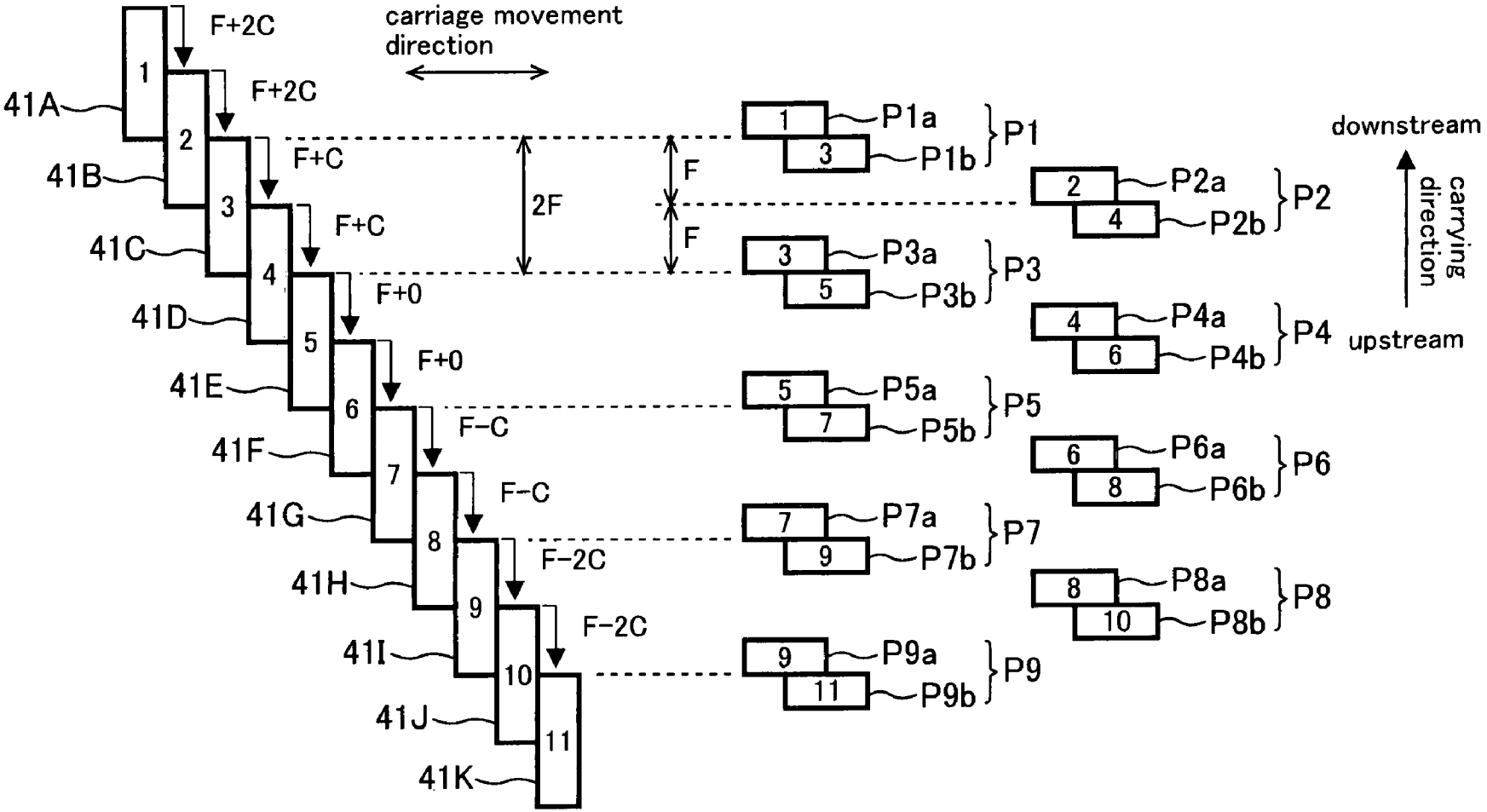
FIG. 26 is an explanatory diagram of a method for printing a test pattern for carry amount correction.

FIG. 26 is an explanatory diagram of the method for printing the test pattern for carry amount correction in the aforementioned Step S601. It should be noted that the rectangles shown on the left in the figure denote the relative position of the head 41 to the print paper P, and are not actually printed on the print paper P. Moreover, the numbers within the rectangles representing the head 41 denote the relative position of the head during the pass of the relevant number. For example, the head 41C in the drawing indicates the relative position of the head in the third pass. It should be noted that "pass" means an operation of ejecting ink when the head 41 moves in the carriage movement direction (dot formation process). In this drawing, it appears as if the head 41 is moving with respect to the print paper P, but this drawing shows merely the relative position between the head 41 and the print paper P, and in actuality the relative positions between them are shifted due to the print paper P being carried in the carrying direction.

Figure 27:
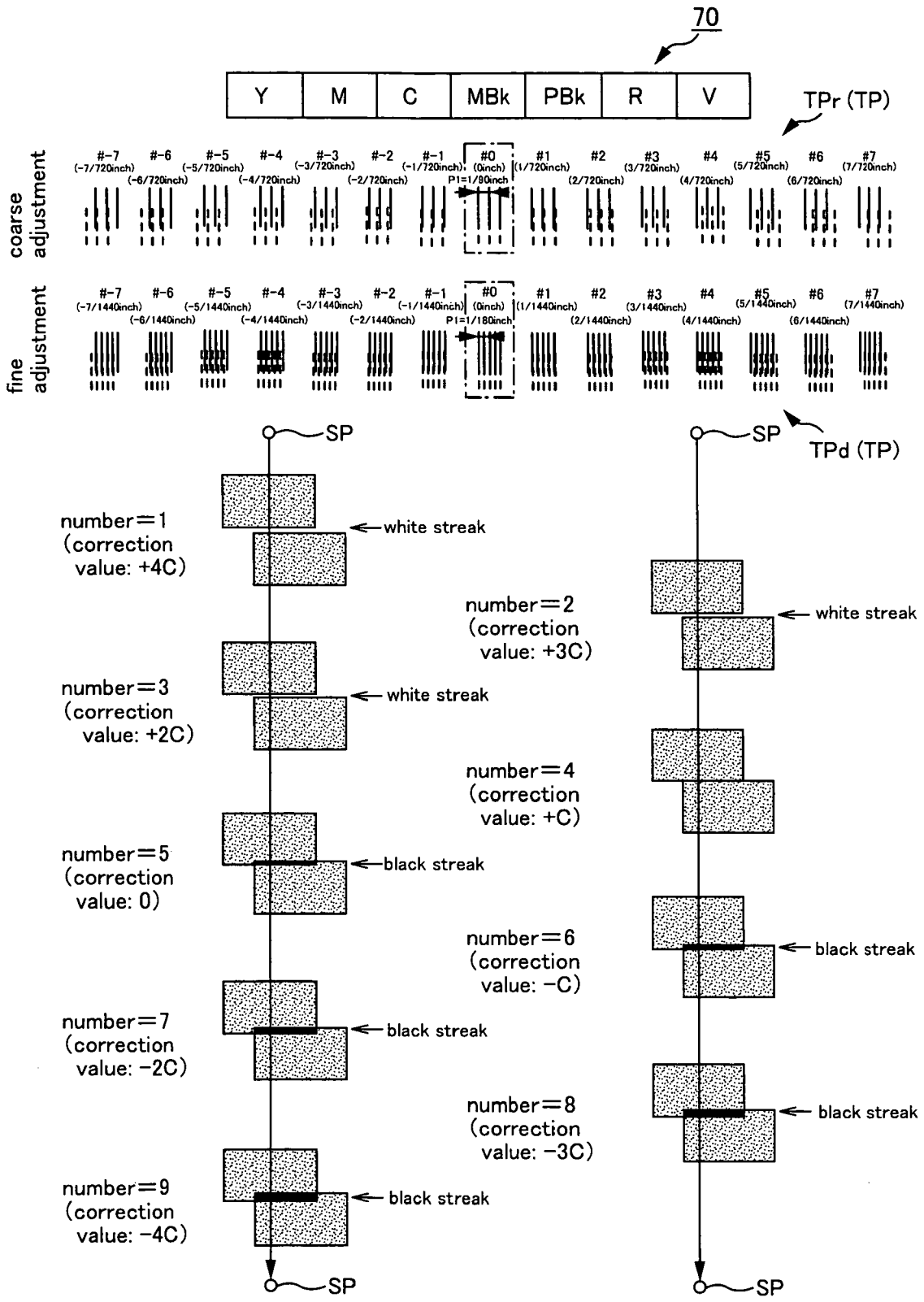
FIG. 27 is an explanatory diagram of a test pattern for carry amount correction.

FIG. 27 is an explanatory diagram of a test pattern for carry amount correction printed with the above-described printing method. Referring to FIGS. 26 and 27, an explanation of the test pattern for carry amount correction and the method for printing the test pattern for carry amount correction according to the present embodiment is given below.

Each correction pattern is made of two band-shaped patterns (band patterns). Of the two band patterns, the band pattern (first band pattern) on the front end side of the paper (upper side in the drawing) is formed by the nozzles on the upstream side in the carrying direction (nozzle #n side). On the other hand, of the two band patterns, the band pattern (second band pattern) on the rear end side of the paper (lower side in the drawing) is formed by the nozzles on the downstream side in the carrying direction (nozzle #1 side). Also, the first band pattern and the second band pattern are formed adjacent to one another in the carrying direction, and a boundary region is formed by these two band patterns. In this boundary region, the dot row formed by the nozzle #n of the first band pattern is adjacent to the dot row formed by the nozzle #1 of the second pattern. In this manner, the print paper P is carried by an amount corresponding substantially to the width of the head (distance from nozzle #1 to nozzle #n) during the period after forming the first band pattern and before forming the second band pattern. Also, the two band patterns are formed shifted in the carriage movement direction, thus clarifying the position of the boundary region constituted by the two band patterns. It should be noted that the numbers within the rectangles representing the band patterns indicate the number of the pass in which those patterns are formed.

The correction patterns are formed while changing the carry amount in a stepwise manner, and thus the state of the boundary region between the band patterns is different for each correction pattern. That is to say, the distance between the dot row in the first pattern that is formed by nozzle #n and the dot row in the second pattern that is formed by nozzle #1 at the boundary region differs depending on the correction pattern (depending on the boundary region). Thus, each correction pattern (or boundary region) corresponds to a different correction amount. As described below, in the present embodiment, the carry amount is changed in a stepwise manner in increments of C (=1/5760 inch) as the plurality of correction patterns (that is, boundary regions) are formed. The various operations of the printer that are described below are achieved in accordance with a program stored in the memory 63 in the printer. Also, this program is constituted by codes for performing the various operations described below.

First, the print paper P is carried such that the head 41 is positioned at the position of head 41A with respect to the print paper P. Then, the first printing operation (pass 1) is performed, printing a first band pattern P1*a* of a correction pattern P1 denoted by "Number=1."

Next, the print paper P is carried by the carry amount F+2C, positioning the head 41 at head 41B in the drawing with respect to the print paper P. Here, the carry amount F is substantially half the width of the head 41 (that is, substantially half the distance from nozzle #1 to nozzle #n). For example, if 180 nozzles are formed in the head 41 at a spacing of 180 dpi, then the carry amount F is ½ inch. Then, the second printing operation (pass 2) is performed, printing a first band pattern P2*a* of a correction pattern P2 denoted by "Number=2."

Next, the print paper P is carried by the carry amount F+2C, positioning the head 41 at head 41C in the drawing with respect to the print paper P. Then, the third printing operation (pass 3) is performed, printing a second band pattern P1*b* of the correction pattern P1 denoted by "Number=1." Thus, the correction pattern P1 denoted by "Number=1" is completed. After the first band pattern P1*a* of the correction pattern P1 has been printed and before printing the second band pattern P1*b* of the correction pattern P1, the print paper P is carried by a carry amount of 2F+4C.

In the third printing operation (pass 3), the first band pattern P3*a* of the correction pattern P3 denoted by "Number=3" is printed at the same time that the second band pattern P1*b* is printed. That is, the two band patterns (P1*b* and P3*a*) are printed in the third printing operation. A blank space is left as these two band patterns are formed. This is done so that the person evaluating the test patterns can compare the correction pattern P1 and the correction pattern P3 more easily.

Next, the print paper P is carried by the carry amount F+C, positioning the head 41 at head 41D in the drawing with respect to the print paper P. Then, the fourth printing operation (pass 4) is performed, printing a second band pattern P2*b* of the correction pattern P2 denoted by "Number=2." Thus, the correction pattern P1 denoted by "Number=2" is completed. After the first band pattern P2*a* of the correction pattern P2 has been printed and before printing the second band pattern P2*b* of the correction pattern P2, the print paper P is carried by a carry amount of 2F+3C. That is to say, when comparing the carry amount (2F+3C) for printing the correction pattern P2 with the carry amount (2F+4C) for printing the correction pattern P1, it can be seen that the two differ by C.

In the fourth printing operation (pass 4), the first band pattern P4*a* of the correction pattern P4 denoted by "Number=4" is printed at the same time that the second band pattern P2*b* is printed. That is, the two band patterns (P2*b* and P4*a*) are printed in the fourth printing operation. Also these two band patterns are formed while leaving a blank space, just like in the previous two band patterns (P1*b* and P3*a*).

Then, substantially the same operations as the operations described above are performed to print the other correction patterns P3 to P9 on the print paper P. However, the carry amount by which the print paper P is carried in the carry operation is changed in a stepwise manner in increments of C (=1/5760 inch) each time the print paper P is carried by the width of the head 41. As a result, the correction patterns are printed such that the spacing between the first band pattern and the second band pattern is different for each correction pattern. In the present embodiment, the width of the head is 1 inch, so that the carry amount is reduced stepwise by 1/5760 inch each time the print paper P is carried by a carry amount of 1 inch.

In the present embodiment, the carry amount F is substantially half the width of the head 41 (that is, substantially half the distance from nozzle #1 to nozzle #n). For example, if 180 nozzles are formed in the head 41, at a spacing of 180 dpi, then the carry amount F is ½ inch. Also, in the present embodiment, "carry amount C" means the reference correction amount serving as a reference for the amount by which the carry amount is corrected, and corresponds to 1/5760 inch, which is the carry amount corresponding to the resolution of the rotary encoder.

When the test pattern is printed, the print paper P is carried intermittently in the carrying direction, but is not carried in the opposite direction. And while the print paper is carried intermittently in the carrying direction, a plurality of correction patterns (that is, a plurality of boundary regions) are finished one after another. Therefore, the positions of the plurality of correction patterns differ with regard to the carrying direction. The correction patterns are finished one after the other, at alternating positions in the carriage movement direction.

The test pattern that is formed in this manner is a pattern in which the plurality of correction patterns are disposed in a staggered (zig-zag) arrangement in the order of the correction amounts. That is to say, the correction patterns with odd numbers (first pattern group) are printed in the carrying direction on the left side of the print paper P, and their positions with respect to the carriage movement direction are substantially the same. On the other hand, the correction patterns with even numbers (second pattern group) are printed in the carrying direction on the right side of the print paper P, and their positions with respect to the carriage movement direction are substantially the same. And the correction patterns of consecutive numbers have different positions in the carriage movement direction. Moreover, the correction amounts of the correction patterns are changed stepwise in the order of their numbers, and the correction patterns are lined up in the carrying direction in the order of their numbers (in the order of the correction amounts). The spacing between the correction patterns in the carrying direction is about half the width of the head 41. In the present embodiment, the width of the head is 1 inch, so that the spacing between the correction patterns in the carrying direction is ½ inch. For example, the spacing in the carrying direction between the correction pattern P1 and the correction pattern P2 is ½ inch. Also the spacing in the carrying direction between, for example, the correction pattern P2 and the correction pattern P3 is ½ inch.

As noted above, each of the correction patterns is formed with a different carry amount. As a result, the spacing of the two band patterns between the correction patterns is different for each correction pattern. Therefore, correction patterns with white streaks (white banding), correction patterns with black streaks (black banding) and correction patterns without streaks (optimal patterns) are printed.

In accordance with the method for printing a test pattern in accordance with the present embodiment, the spacing (F) between a given correction pattern (or one boundary region) and another correction pattern (or another boundary region) is shorter than the carry amount (2F) that the medium is carried after formation of the first band pattern and before formation of the second band pattern. Therefore, with the method for printing a test pattern in accordance with the present embodiment, it is possible to print a large number of correction patterns on a single print paper. Moreover, since a large number of correction patterns can be formed, it is possible to form the correction patterns for a large number of correction values, so that the optimal correction value can be found in a short period of time and this task can be accomplished more efficiently.

Furthermore, with the method for printing a test pattern in accordance with the present embodiment, during the period after forming the first band pattern of a given correction pattern and before forming the second band pattern of that correction pattern, the first band pattern of the next correction pattern is formed. Therefore, the spacing of the correction patterns in the carrying direction can be made shorter, so that a large number of correction patterns can be formed on the print paper.

Also, with the test pattern printing method of the present embodiment, when the second band pattern of a particular correction pattern (for example, the correction pattern denoted by "Number=1") is formed, then the first band pattern of another correction pattern (for example, the correction pattern denoted by "Number=3") is formed at the same time in the same pass. Therefore, a large number of correction patterns can be formed on the print paper, and it is possible to prepare the test pattern in a short time.

Method for Detecting the Test Pattern for Carry Amount Correction

Figure 28A:
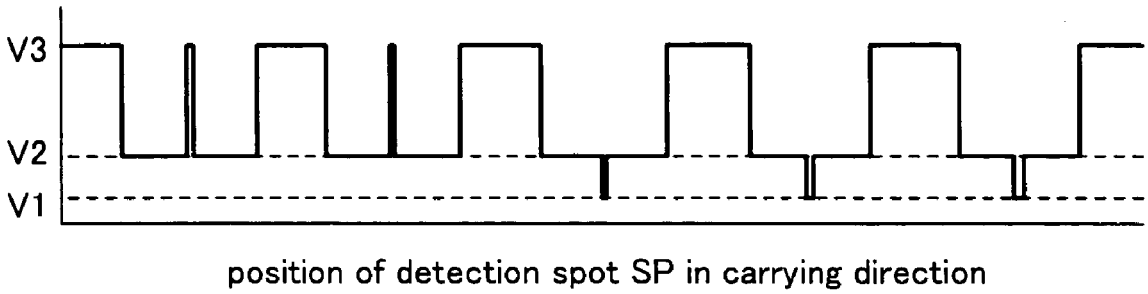
FIG. 28A is an explanatory diagram illustrating a method by which the optical sensor detects the test pattern for carry amount correction shown on the left side in FIG. 27.
Figure 28B:
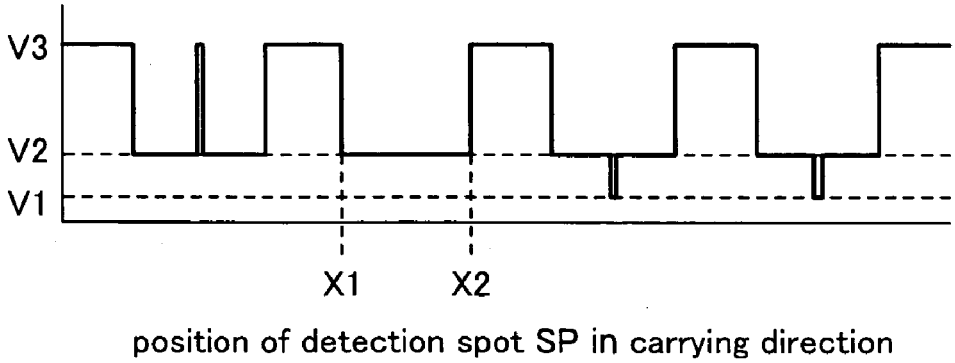
FIG. 28B is an explanatory diagram illustrating a method by which the optical sensor detects the test pattern for carry amount correction shown on the right side in FIG. 27.

Referring to FIG. 28A and FIG. 28B, a description of a method for detecting a test pattern for carry amount correction with the optical sensor 55 is given below. FIG. 28A is an explanatory diagram illustrating a method for detecting the test pattern for carry amount correction on the left side in FIG. 27 with the optical sensor 55. FIG. 28B is an explanatory diagram illustrating a method for detecting the test pattern for carry amount correction on the right side in FIG. 27 with the optical sensor 55.

The detection of the test pattern for carry amount correction is carried out based on the output of the first light-receiving section 552 of the optical sensor 55. That is to say, the detection of the test pattern for carry amount correction is carried out based on the light amount of the diffused reflection light.

Since the evaluation is performed with the diffused reflection light using the first light-receiving section 552 of the optical sensor 55, the light amount that is received by the first light-receiving section 552 decreases and the output voltage of the optical sensor 55 becomes low if there is a test pattern within the detection spot SP. If there is a portion in which the test patterns overlap in the detection spot SP, then the light amount received by the first light-receiving section 552 further decreases and the output voltage of the optical sensor 55 becomes even lower. The reason why the output voltage of the optical sensor 55 becomes even lower when an overlapping portion of the test patterns is within the detection spot SP than when the test patterns are within the detection spot SP is that in the overlapping portions of the test patterns, the darkness of the ink is higher, so that more light is scattered and the amount of light received by the first light-receiving portion 552 is reduced even more. Conversely, if there is no test pattern within the detection spot SP, then the amount of light received by the first light-receiving section 552 increases, and the output voltage of the optical sensor 55 becomes high.

When the optical sensor 55 detects the test patterns, the carriage 31 moves to a position at which the test pattern on the left side in FIG. 27 can be detected by the optical sensor 55. From this state, the carry roller 23 carries the print paper P in the carrying direction. When the print paper P is carried, the position detected by the detection spot SP shifts in the carrying direction. That is to say, when the print paper P is carried, the detection spot SP detects the test patterns on the left side in FIG. 27. If there is no test pattern at the position detected by the detection spot SP, then the optical sensor 55 outputs a relatively high voltage. In the present embodiment, this relatively high voltage is for example the voltage V3 in FIGS. 28A and 28B. If there is a test pattern at the position detected by the detection spot SP, then the optical sensor 55 outputs a relatively low voltage. In the present embodiment, this relatively low voltage is for example the voltage V2 in FIGS. 28A and 28B. If there is an overlapping portion of a test pattern at the position detected by the detection spot SP, then the optical sensor 55 outputs a low voltage. In the present embodiment, this low voltage is for example the voltage V1 in FIGS. 28A and 28.

Thus, when the optical sensor 55 detects the test patterns on the left in FIG. 27, the relation between the position of the detection spot SP in the carrying direction and the output value of the optical sensor 55 becomes as shown in FIG. 28A.

Next, the carry roller 23 carries the print paper P against the carrying direction. Then, the carriage 31 is moved to a position where the optical sensor 55 can detect the test patterns on the right side in FIG. 27. From this state, the carry roller 23 carries the print paper P in the carrying direction. When the print paper P is carried, the detection spot SP detects the test patterns on the right side in FIG. 27. When the optical sensor 55 detects the test pattern on the right in FIG. 27, the relation between the position of the detection spot SP in the carrying direction and the output value of the optical sensor 55 becomes as shown in FIG. 28B.

The following is an explanation of the medium carry amount determination process based on the detection result of the test patterns for carry amount correction output by the optical sensor 55 in Step S602 of FIG. 25.

The printer 1 detects the portion where the state in which the output value of the optical sensor 55 in FIGS. 28A and 28B continues to be V2 for a relatively long time. The portion where the state in which the output value of the optical sensor 55 continues to be V2 for a relatively long time is the portion X1-X2 in FIG. 28B. The portion X1-X2 in FIG. 28B corresponds to the output values when the optical sensor 55 detects the test pattern represented by "number=4" (correction value: +C) on the right side in FIG. 27.

Moreover, in Step S602 in FIG. 25, the printer 1 determines the medium carry amount, setting the correction value of the medium carry amount to +C. After determining the medium carry amount, the series of processes for improving image quality is terminated.

The following is an explanation of the reason why the ejection test process is carried out first in the series of processes for improving image quality. The reason why the ejection test process is carried out first is to increase the reliability of the test patterns that are formed when executing the dot formation position correction process and the medium carry amount determination process, which are carried out after it.

The following is an explanation of the hypothetical case that the dot formation position correction process is carried out even though there are nozzles that cannot eject ink. If a test pattern for correcting the dot formation positions were prepared even though there are nozzles that cannot eject ink, then there would be locations in the test pattern onto which no ink is ejected even though ink should be ejected. Then, if the optical sensor detected those locations, the test pattern for correcting the dot formation positions would not be detected accurately. This is because when there are locations in the test pattern at which no ink is ejected even though ink should be ejected, then the test pattern at that portion is formed more lightly. Thus, there is the possibility that the optical sensor cannot detect the portions of the test pattern formed lightly. If the optical sensor cannot detect the test pattern accurately, the printer cannot correct the dot formation positions accurately.

Further, the following is an explanation of the case that the medium carry amount determination process is carried out even though there are nozzles that cannot eject ink. Let us assume that the nozzle that cannot eject ink is the nozzle #180, for example. In this case, the spacing between the first band pattern and the second band pattern formed in order to determine the medium carry amount becomes wider by an amount corresponding to the nozzle #180. Consequently, since there is a deviation in the spacing between the band patterns detected by the optical sensor in order to determine the medium carry amount, the printer cannot determine the medium carry amount accurately.

Consequently, in the present embodiment, the ejection test and the confirmation on whether or not all nozzles eject ink are carried out prior to the dot formation position correction process and the medium carry amount determination process. Then, if there are nozzles that cannot eject ink, a cleaning process is carried out, and the next process is performed after ensuring that ink is ejected from all nozzles. Consequently, the test patterns are formed accurately when carrying out the dot formation position correction process and the medium carry amount determination process. Thus, the printer can correct the dot formation positions accurately and also can determine the medium carry amount accurately.

In the explanatory diagram of the test pattern for carry amount correction shown in FIG. 27, the test pattern TPr for coarse adjustment is printed below the test pattern group 70 used for the nozzle ejection test. The test pattern TPd for fine adjustment is printed below the test pattern TPr for coarse adjustment. The test pattern for carry amount correction is printed below the test pattern TPd for fine adjustment. Since the individual test patterns are printed in order on the print paper P in this way, the test patterns for performing the series of processes for improving image quality are all printed on one print paper in the present embodiment. Consequently, the test patterns for carrying out the various adjustment processes for improving image quality do not need to be printed on separate print papers, so that the print paper can be utilized efficiently.

Second Embodiment

===(2) Basic Configuration of the Second Embodiment===

The following is a description of the basic configuration of a second embodiment.

The printing system according to this second embodiment is substantially the same as the printing system according to the first embodiment (see FIG. 1). Also the basic processing performed by the printer driver of this second embodiment is substantially the same as the basic processing performed by the printer driver of the first embodiment (see FIG. 2). Therefore, corresponding explanations for the second embodiment have been omitted.

Figure 29:
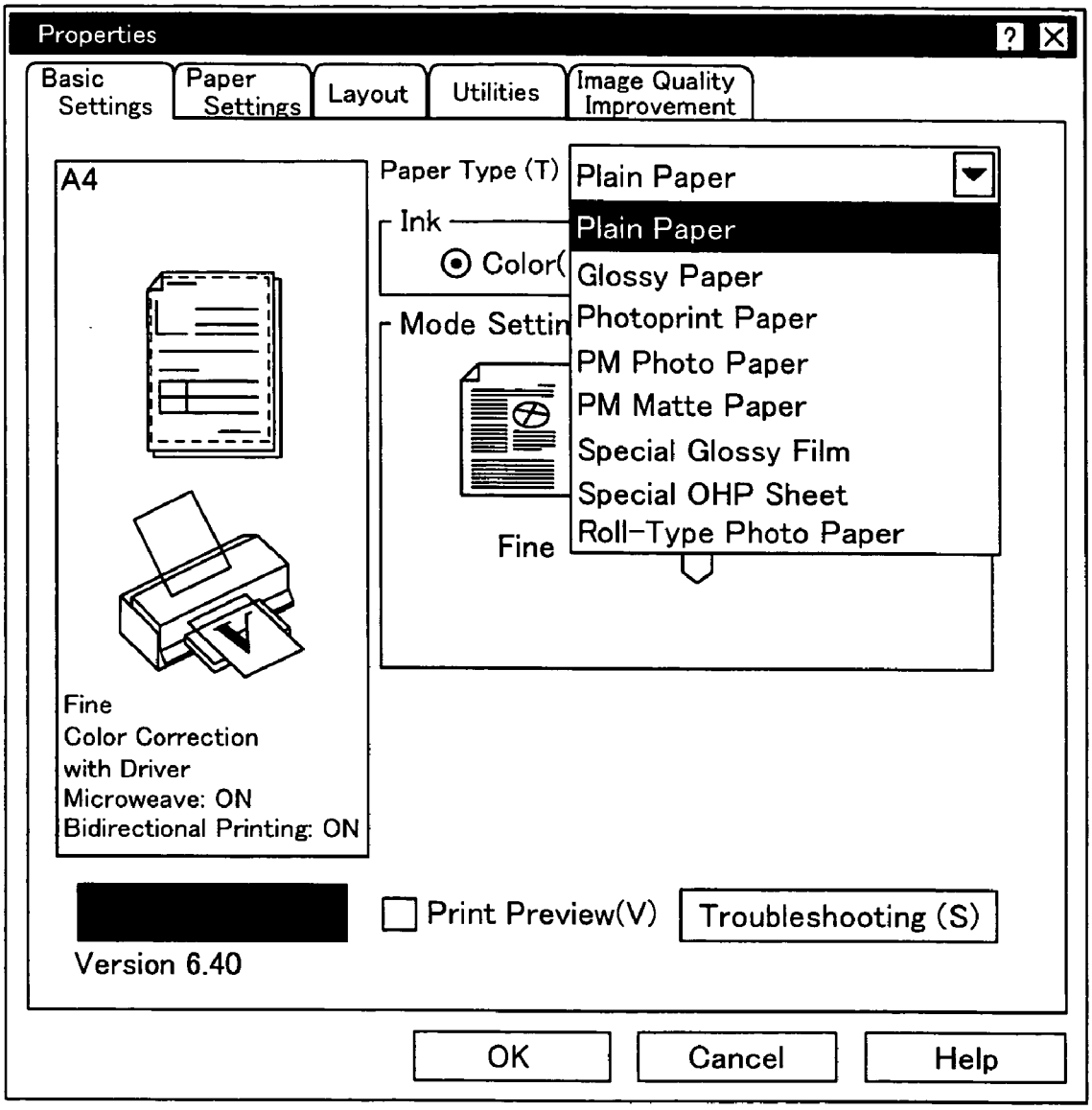
FIG. 29 is an explanatory diagram of a user interface of the printer driver of the second embodiment.

FIG. 29 is an explanatory diagram of a user interface of the printer driver of the second embodiment. One difference to the user interface of the printer driver in the first embodiment (see FIG. 3) is that there is no image quality improvement button 80 in the screen for the basic settings. Also, in the property screen of the user interface of the printer driver of the second embodiment, a tab "image quality improvement" has been provided in addition to the tabs "basic settings", "paper settings", "layout" and "utilities". Other aspects are substantially the same as in the first embodiment, so that their explanations have been omitted.

The printer and the rotary encoder of the second embodiment are substantially the same as the printer (see FIGS. 4 to 6) and the rotary encoder (see FIGS. 7 and 8) of the first embodiment. Also the processes during printing with the second embodiment are substantially the same as the processes during printing with the first embodiment (see FIGS. 9 and 10). Moreover, also the nozzles in the second embodiment are substantially the same as the nozzles in the first embodiment (see FIG. 11). Also the driving of the head in the second embodiment is substantially the same as the driving of the head in the first embodiment. Moreover, also the optical sensor in the second embodiment is substantially the same as the optical sensor in the first embodiment. Therefore, corresponding explanations for the second embodiment have been omitted.

===(2) Regarding the Case that the User Gives an Instruction to Improve Image Quality from the Utilities Screen ===

Figure 30:
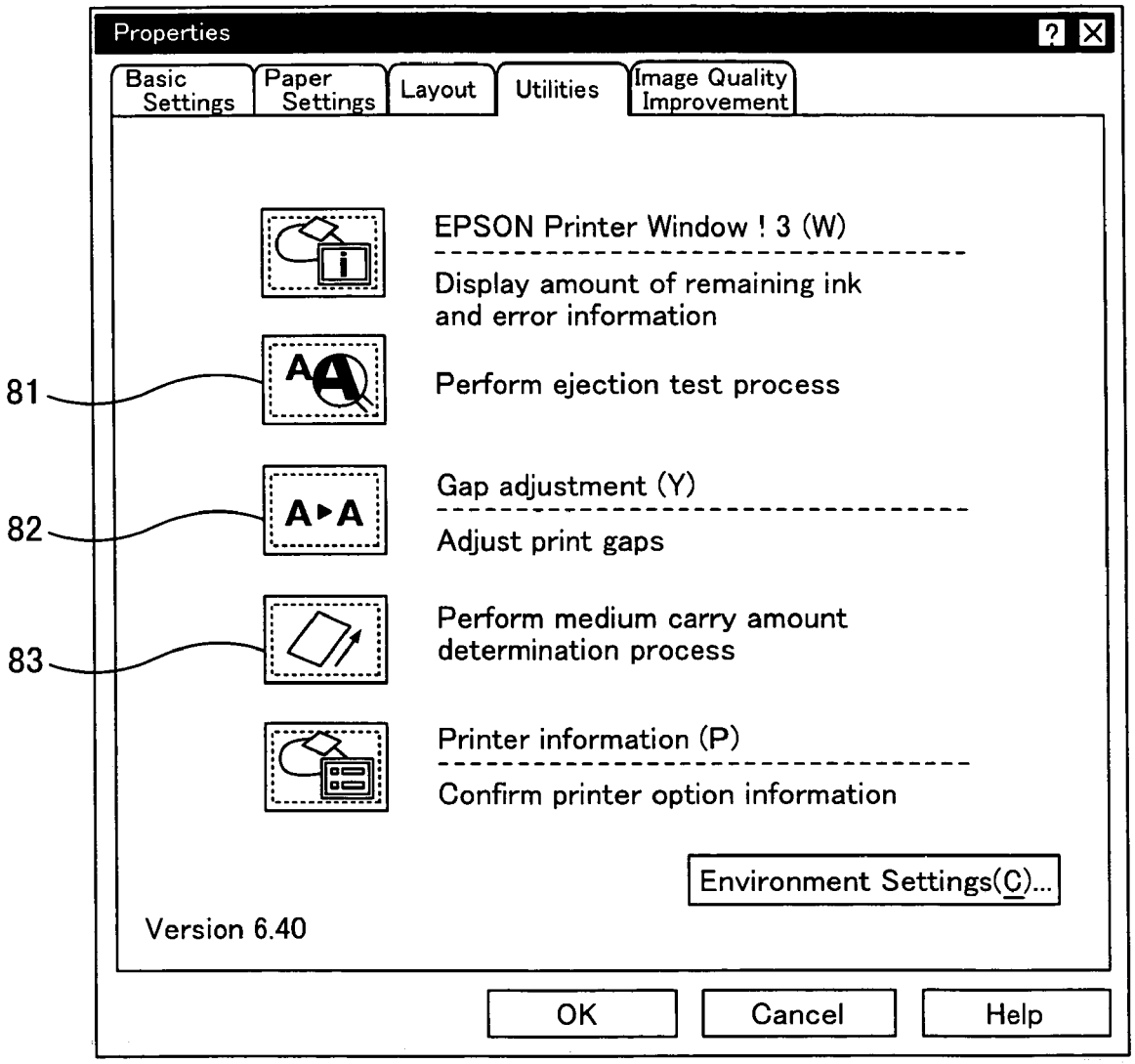
FIG. 30 is an explanatory diagram illustrating a case in which a user enters an instruction to improve image quality via the user interface when the user wishes to make the printer execute image-quality improvement.

The following is a description of the case that the user enters an instruction to improve image quality into the printer 1 from the utilities screen of the user interface. FIG. 30 is an explanatory diagram illustrating the case that the user enters an instruction to improve image quality into the printer 1 from the utilities screen of the user interface.

When the image quality of printed print paper P has become poor, the user can input an instruction to improve image quality through the user interface into the printer driver. When the printer driver receives such an instruction to improve image quality, it lets the printer 1 perform an image quality improvement process.

The screen shown in FIG. 30 is displayed when the user has selected the tab "utilities" in the user interface shown in FIG. 29. That is to say, to display the screen shown in FIG. 30, the user moves the cursor displayed on the screen with the mouse 130B to the icon labeled "utilities" of among the icons at the top of the screen. Then, the user can click the mouse 130B while the cursor is on the icon labeled "utilities".

In the screen shown in FIG. 30, icons for entering instructions to adjust a variety of different objects of the printer 1 are displayed. If the user selects icon 81, the printer 1 performs the ejection test process for adjusting clogging of the nozzles of the ink ejecting section. This ejection test process is carried out by forming a predetermined test pattern by actually ejecting colored ink from the nozzles. Then, if the test result is that ejection defects, such as clogging of the nozzles, are discovered, then the nozzles are cleaned. This ejection test process is a process similar to the ejection test process of the first embodiment (see FIGS. 15 to 21), so that its further explanation has been omitted.

If the user has selected icon 82, then the printer 1 performs a print gap adjustment process. This print gap adjustment process is a process for adjusting the position at which ink ejected from the ink ejecting section lands on the print paper P. That is to say, the print gap adjustment process is a process for correcting the dot formation position. This dot formation position correction process is a process similar to the dot formation position correction process of the first embodiment (see FIGS. 22 to 24), so that its further explanation has been omitted.

If the user has selected icon 83, then the printer 1 performs a medium carry amount determination process for adjusting the carry amount by which the print paper P is carried. This medium carry amount determination process is a process similar to the ejection test process of the first embodiment (see FIGS. 25 to 28), so that its further explanation has been omitted.

To select any of the icons 81, 82 and 83, the user moves the cursor displayed on the screen with the mouse 130B to those icons 81, 82 and 83. Then, the user can click the mouse 130B while the cursor is on the respective icon 81, 82 or 83.

===(2) Regarding the Case that the User Gives an Instruction to Improve Image Quality by Selecting the Image Quality Improvement Button ===

Figure 31:
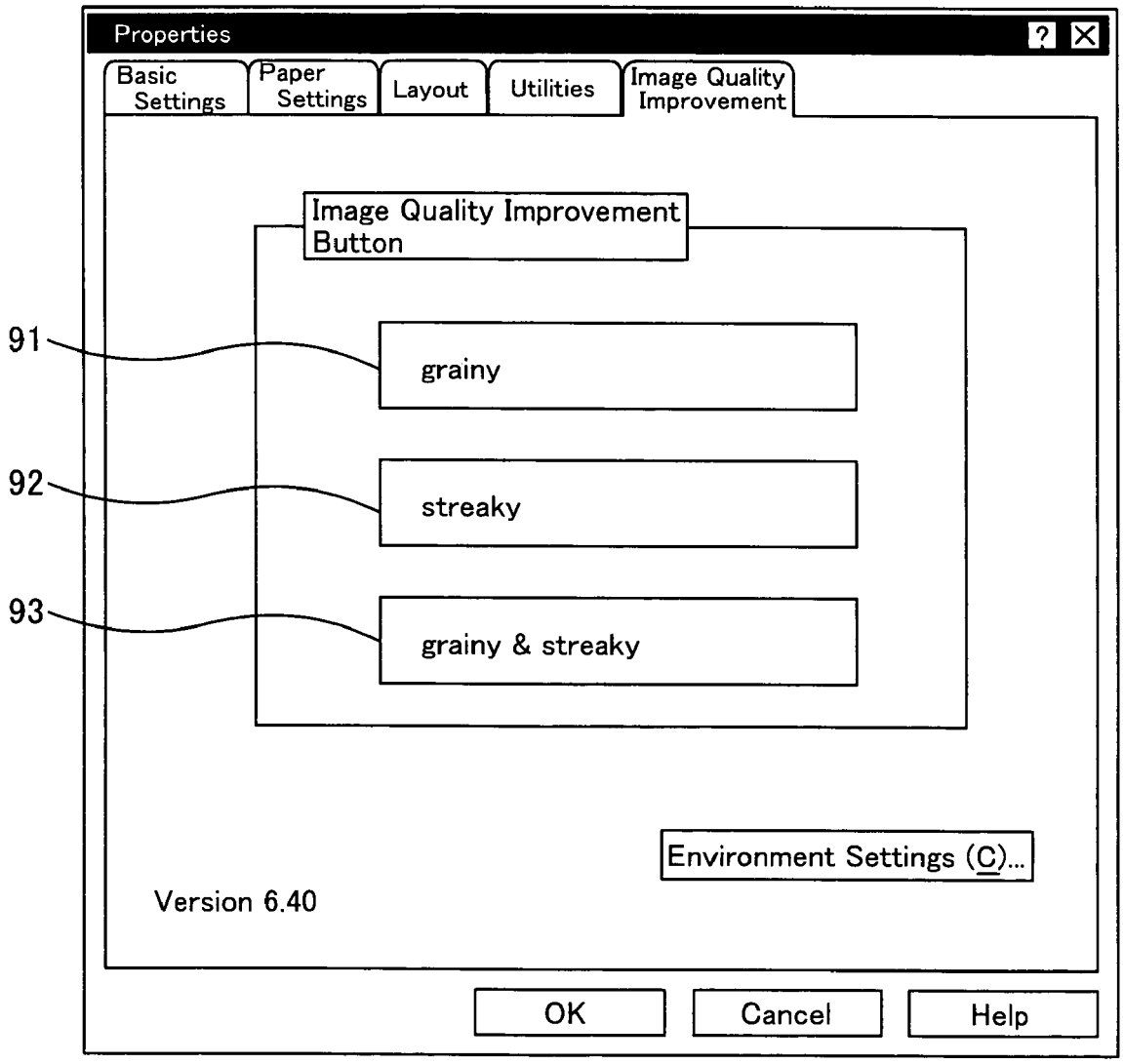
FIG. 31 is an explanatory diagram illustrating a case in which a user enters an instruction to improve image quality via the user interface when the user wishes to make the printer execute image-quality improvement in the present embodiment.

The following is a description of the case that the user enters an instruction to improve image quality into the printer 1 from the image quality improvement screen of the user interface. FIG. 31 is an explanatory diagram illustrating the case that the user enters an instruction to improve image quality into the printer 1 from the image quality improvement screen of the user interface.

When the image quality of printed print paper P has become poor, the user can input an instruction to improve image quality through the user interface into the printer driver. When the printer driver receives such an instruction to improve image quality, it lets the printer 1 perform an image quality improvement process.

The screen shown in FIG. 31 is displayed when the user has selected "image quality improvement" in the user interface shown in FIG. 29. That is to say, to display the screen shown in FIG. 31, the user moves the cursor displayed on the screen with the mouse 130B to the icon labeled "image quality improvement" among the icons at the top of the screen. Then, the user can click the mouse 130B while the cursor is on the icon labeled "image quality improvement".

In the screen shown in FIG. 31, a plurality of image-quality display sections representing different image-quality states are displayed on the screen. That is to say, in the screen shown in FIG. 31, icons 91, 92 and 93 are displayed, which represent image-quality states of a print paper P that has been printed. Icon 91 stands for the case that the image quality of the printed print paper P is "grainy". Icon 92 stands for the case that the image quality of the printed print paper P is "streaky". And icon 93 stands for the case that the image quality of the printed print paper P is "grainy and streaky". That is to say, the image-quality state represented by icon 93 is a combination of the image-quality state represented by icon 91 and the image-quality state represented by icon 92.

Moreover, the icons 91, 92 and 93 respectively correspond to different adjustment processes for adjusting different objects (in the present embodiment, those are clogging of the nozzles of the ink ejecting section, the carry amount by which the medium is carried, and the position at which ink ejected from the ink ejecting section lands on the medium) for improving those image-quality states. Icon 91 corresponds to the dot formation position correction process. Icon 92 corresponds to the ejection test process and the medium carry amount determination process. Icon 93 corresponds to the ejection test process, the dot formation position correction process and the medium carry amount determination process. Thus, the icons 92 and 93 each correspond to a plurality of processes for improving image quality. If any of these icons is selected by the user, the printer 1 carries out the process or processes correlated to that icon.

Moreover, the image-quality state represented by icon 93 is a combination of the image-quality state represented by icon 91 and the image-quality state represented by icon 92. Thus, icon 93 corresponds to a combination of the process corresponding to icon 91 and the processes corresponding to icon 92. Consequently, if icon 93 is selected, the printer 1 carries out the process corresponding to icon 91 as well as the processes corresponding to icon 92. Therefore, if the image quality of the print paper P that has been printed is "grainy" as well as "streaky", then the user does not have to select icon 91 and icon 92 separately, but can improve image quality by simply selecting icon 93.

===(2) Regarding the Processing when the User Gives an Instruction to Improve Image Quality by Selecting the Image Quality Improvement Button ===

Figure 32:
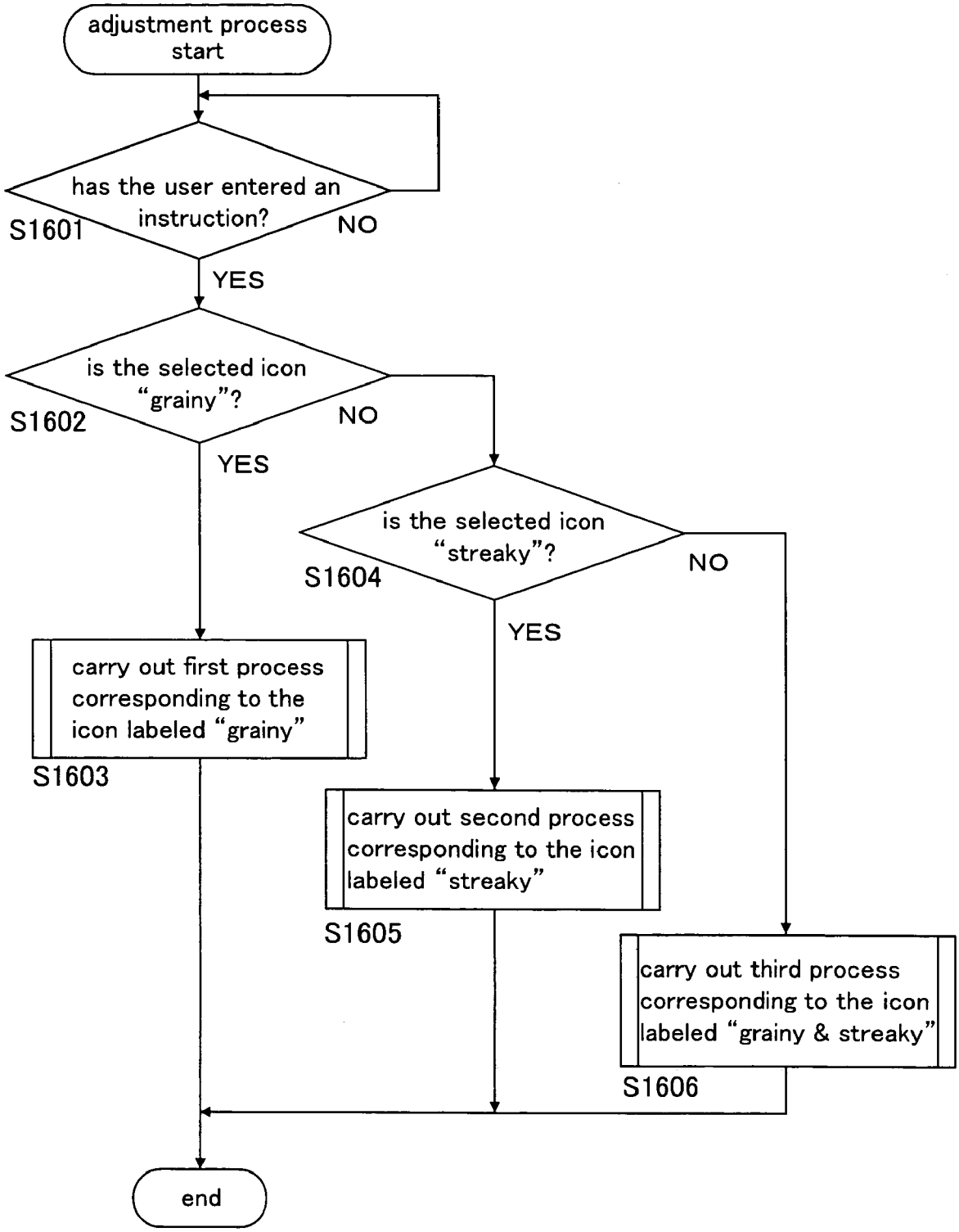
FIG. 32 is a flowchart illustrating the adjustment process that is carried out when any of the icons 91, 92 and 93 has been selected.
Figure 33:
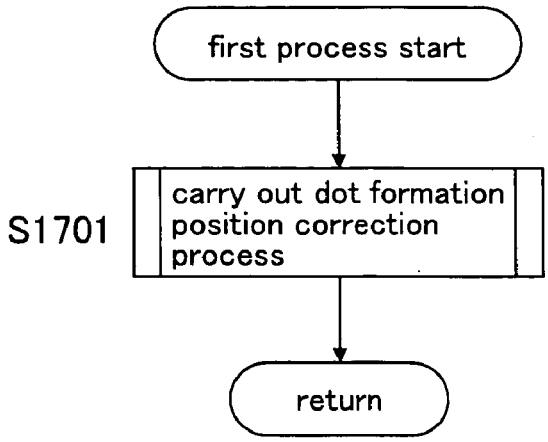
FIG. 33 is a flowchart illustrating the adjustment process that is carried out when icon 91 has been selected.
Figure 34:
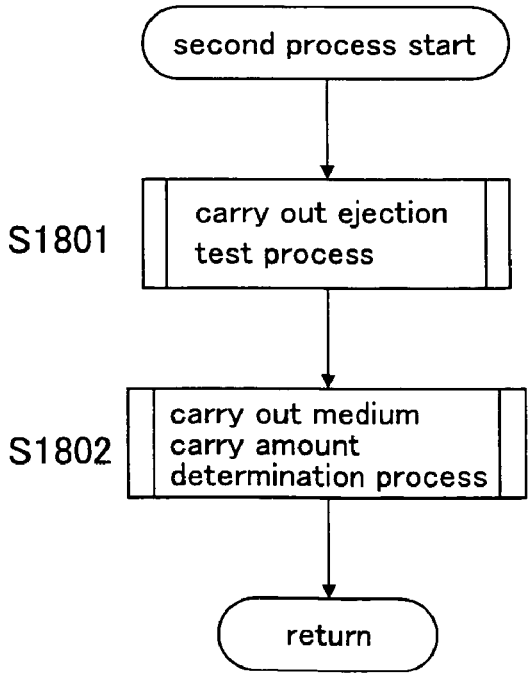
FIG. 34 is a flowchart illustrating the adjustment process that is carried out when icon 92 has been selected.
Figure 35:
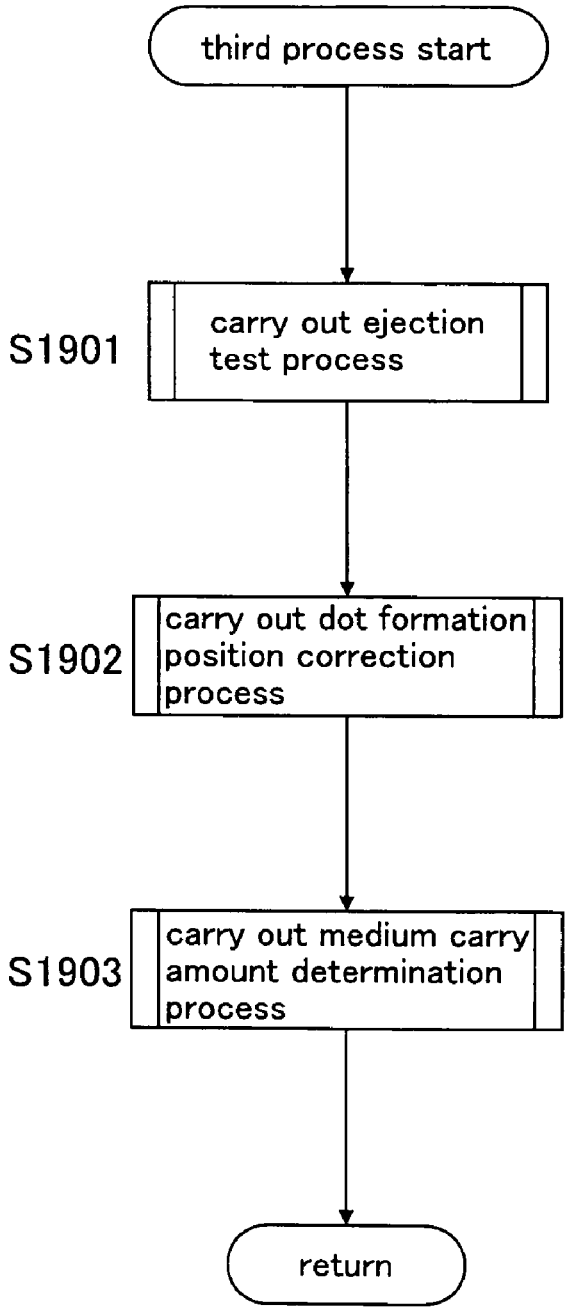
FIG. 35 is a flowchart illustrating the adjustment process that is carried out when icon 93 has been selected.

Referring to FIGS. 32 to 35, an explanation of the adjustment process that is carried out when the user has selected any of the icons 91, 92 and 93 is given below. FIG. 32 is a flowchart illustrating the adjustment process that is carried out when any of the icons 91, 92 and 93 has been selected. FIG. 33 is a flowchart illustrating the adjustment process that is carried out when icon 91 has been selected. FIG. 34 is a flowchart illustrating the adjustment process that is carried out when icon 92 has been selected. FIG. 35 is a flowchart illustrating the adjustment process that is carried out when icon 93 has been selected.

First, the adjustment process that is carried out when any of the icons 91, 92 and 93 has been selected is explained with reference to FIG. 32.

The user moves the cursor displayed in the screen shown in FIG. 31 with the mouse 130B to the icon 91, 92 or 93, which are also displayed in the screen. If the user clicks the mouse 130B while the cursor is on one of the icons 91, 92 and 93, then an instruction to improve image quality is entered into the printer 1 (Step S1601). The procedure is on standby until an instruction to improve image quality is entered into the printer 1.

When an instruction to improve image quality has been entered into the printer 1, the procedure advances to Step S1602.

In Step S1602, the printer 1 determines whether or not the icon that has been selected by the user on the screen displayed in FIG. 31 is the icon 91. That is to say, the printer 1 determines whether or not the icon indicating that the image quality of the printed print paper P is "grainy" has been selected. If it is determined in Step S1602 that the selected icon is icon 91, then the procedure advances to Step S1603.

In Step S1603, the printer 1 carries out a first process corresponding to icon 91 (adjustment process for adjusting the position at which ink ejected by the ink ejecting section lands on the medium). The first process carried out in Step S1603 is explained with reference to FIG. 33. When the first process shown in FIG. 33 is started, the printer 1 carries out a dot formation position correction process in Step S1701. The dot formation position correction process in Step S1701 is the same as the process from Step S501 to Step S504 performed in the dot formation position correction process shown in FIG. 23, so that further explanations have been omitted. If it is determined in Step S1602 that the selected icon is not icon 91, then the procedure advances to Step S1604.

In Step S1604, the printer 1 determines whether or not the icon that has been selected by the user on the screen displayed in FIG. 31 is the icon 92. That is to say, the printer 1 determines whether or not the icon indicating that the image quality of the printed print paper P is "streaky" has been selected. If it is determined in Step S1604 that the selected icon is icon 92, then the procedure advances to Step S1605.

In Step S1605, the printer 1 carries out a second process corresponding to icon 92 (adjustment process for adjusting clogging of the nozzles of the ink ejecting section and adjustment process for adjusting the carry amount by which the medium is carried). The second process carried out in Step S1605 is explained with reference to FIG. 34. When the second process shown in FIG. 34 is started, the printer 1 carries out a ejection test process in Step S1801. Then, in Step S1802, the printer 1 carries out a medium carry amount determination process. The ejection test process carried out in Step S1801 is the same as the process from Step S401 to Step S405 performed in the ejection test process shown in FIG. 15, so that further explanations have been omitted. The medium carry amount determination process carried out in Step S1802 is the same as the process from Step S601 to Step S602 performed in the medium carry amount determination process shown in FIG. 25, so that further explanations have been omitted.

If it is determined in Step S1604 that the selected icon is not icon 92 (that is, that the selected icon is icon 93), then the procedure advances to Step S1606.

In Step S1606, the printer 1 carries out a third process corresponding to icon 93 (adjustment process for adjusting clogging of the nozzles of the ink ejecting section, adjustment process for adjusting the position at which ink ejected from the ink ejecting section lands on the medium, and adjustment process for adjusting the carry amount by which the medium is carried).

The third process carried out in Step S1606 is explained with reference to FIG. 35. When the third process shown in FIG. 35 is started, the printer 1 carries out an ejection test process in Step S1901. Then, in Step S1902, the printer 1 carries out a dot formation position correction process. Then, in Step S1903, the printer 1 carries out a medium carry amount determination process.

The ejection test process carried out in Step S1901 is the same as the process from Step S401 to Step S405 performed in the ejection test process shown in FIG. 15, so that further explanations have been omitted. The dot formation position correction process in Step S1902 is the same as the process from Step S501 to Step S504 performed in the dot formation position correction process shown in FIG. 23, so that further explanations have been omitted. Further, the medium carry amount determination process carried out in Step S1903 is the same as the process from Step S601 to Step S602 performed in the medium carry amount determination process shown in FIG. 25, so that further explanations have been omitted.

When the processing of Step S1603, Step S1605 and Step S1606 has been finished, the adjustment process carried out in the case that one of the icons 91, 92 and 93 shown in FIG. 32 has been selected is finished.

The following is an explanation of the reason why the ejection test process is carried out first in the second process shown in FIG. 34 and the third process shown in FIG. 35. The reason why the ejection test is carried out first is to increase the reliability of the test patterns that are formed when executing the dot formation position correction process and the medium carry amount determination process, which are carried out after it.

The following is an explanation of the hypothetical case that the dot formation position correction process is carried out even though there are nozzles that cannot eject ink. If a test pattern for correcting the dot formation positions were prepared even though there are nozzles that cannot eject ink, then there would be locations in the test pattern onto which no ink is ejected even though ink should be ejected. Then, if the optical sensor detected those locations, the test pattern for correcting the dot formation positions would not be detected accurately. This is because if there are locations in the test pattern at which no ink is ejected even though ink should be ejected, then the test pattern at those portions is formed more lightly. Thus, there is the possibility that the optical sensor cannot detect the portions at which the test pattern is formed lightly. If the optical sensor cannot detect the test pattern accurately, the printer cannot correct the dot formation positions accurately.

The following is an explanation of the case that the medium carry amount determination process is carried out even though there are nozzles that cannot eject ink. Let us assume that the nozzle that cannot eject ink is the nozzle #180, for example. In this case, the spacing between the first band pattern and the second band pattern formed in order to determine the medium carry amount becomes wider by an amount corresponding to the nozzle #180. Consequently, since there is a deviation in the spacing between the band patterns detected with the optical sensor in order to determine the medium carry amount, the printer cannot determine the medium carry amount accurately.

Consequently, in the present embodiment, the ejection test and the confirmation on whether or not all nozzles eject ink are carried out prior to the dot formation position correction process and the medium carry amount determination process. Then, if there are nozzles that cannot eject ink, a cleaning process is carried out, and the next process is performed after ensuring that ink is ejected from all nozzles. Consequently, the test patterns are formed accurately when carrying out the dot formation position correction process and the medium carry amount determination process. Thus, the printer can correct the dot formation positions accurately and also can determine the medium carry amount accurately.

===(2) About the Differences Between the Case that an Instruction to Improve Image Quality is Entered from the Utilities Screen and the Case that an Instruction to Improve Image Quality is Entered from the Image Quality Improvement Screen ===

Comparing FIG. 30 with FIG. 31, a discussion is made of the differences between the case that an instruction to improve image quality is entered into the printer 1 by the user from the utilities screen of the user interface and the case that an instruction to improve image quality is entered into the printer 1 from the image quality improvement screen of the user interface.

FIG. 30 is an explanatory diagram illustrating the case that the user enters an instruction to improve image quality into the printer 1 from the utilities screen of the user interface. FIG. 31 is an explanatory diagram illustrating the case that the user enters an instruction to improve image quality into the printer 1 from the image quality improvement screen of the user interface.

In the screen shown in FIG. 30, icons for entering a instructions to adjust a variety of different objects of the printer 1 are displayed.

The icons 81, 82 and 83 respectively correspond, in a 1-to-1 correspondence, to adjustment processes for adjusting different objects (in the present embodiment, those are clogging of the nozzles of the ink ejecting section, the position at which ink ejected from the ink ejecting section lands on the medium and the carry amount by which the medium is carried) for improving those image-quality states. If any of those icons is selected by the user, then the adjustment process corresponding to that icon is carried out.

Consequently, if the image quality of printed print paper P has deteriorated, then users have to determine by themselves the reason why the image quality has deteriorated. That is to say, users have to judge whether the reason why the image quality has deteriorated lies in clogging of the nozzles, the position at which ink lands on the medium, or the carry amount by which the medium is carried. Then, when the user has decided the cause of the deterioration of image quality, the user selects the icon for adjusting the object which has been presumed as the cause of the deterioration of image quality, to let the printer 1 carry out the adjustment process corresponding to that icon.

Now, if the user is not well versed in the functionality of the printer, then the user cannot accurately judge the cause of the drop in image quality. If the user cannot accurately judge the cause of the drop in image quality, then the user cannot select the proper icon corresponding to the adjustment process for improving image quality. In this case, the user cannot improve the image quality. The reason for this is that if the user cannot select the proper icon for letting the printer 1 carry out the adjustment process for improving image quality, and selects another icon, then the printer 1 will not carry out the process for improving image quality, but carry out an adjustment process corresponding to that other icon.

This is explained with an example in which the state of image quality of the printer print paper P is "streaky". Let us assume that the user notices that the state of the image quality of printed print paper P is "streaky", and decides that the cause of the image quality deterioration is clogging of the nozzles of the ink ejecting section. In this case, the user selects the icon 81 and lets the printer 1 carry out the ejection test process. However, if the actual cause of the image deterioration was not clogging of the nozzles of the ink ejecting section but the medium carry amount, then there is no improvement of the image quality deterioration.

By contrast, in the screen shown in FIG. 31, a plurality of image-quality display sections representing different image-quality states are displayed on the screen. That is to say, in the screen shown in FIG. 31, icons 91, 92 and 93 are displayed, which represent image-quality states of a print paper P that has been printed. The icon 91 stands for the case that the image quality of the printed print paper P is "grainy". The icon 92 stands for the case that the image quality of the printed print paper P is "streaky". Further, the icon 93 stands for the case that the image quality of the printed print paper P is "grainy and streaky".

Moreover, the icons 91, 92 and 93 respectively correspond to different adjustment processes for adjusting different objects (in the present embodiment, those are clogging of the nozzles of the ink ejecting section, the carry amount by which the medium is carried, and the position at which ink ejected from the ink ejecting section lands on the medium) in order to improve these image-quality states. Icon 91 corresponds to the dot formation position correction process. Icon 92 corresponds to the ejection test process and the medium carry amount determination process. Icon 93 corresponds to the ejection test process, the dot formation position correction process, and the medium carry amount determination process.

In this way, the icons 92 and 93 each correspond to a plurality of processes for improving image quality. If any of those icons is selected by the user, then the adjustment process corresponding to that icon is carried out.

Since the icons 91, 92 and 93 display image-quality states, even users who are not well versed in the functionality of the printer can accurately select the icon for letting the printer 1 carry out the proper adjustment process.

For example, if the user notices that the state of the image quality of printed print paper P is "streaky", then it is only necessary for the user to select the icon 92 marked "streaky". Icon 92 corresponds to the ejection test process and the medium carry amount determination process. When icon 92 is selected, the printer 1 carries out an ejection test process and a medium carry amount determination process. Thus, the "streaky" state of the image quality of the printed print paper P is improved.

In this way, icon 92 is labeled as "streaky". Moreover, icon 92 corresponds to the ejection test process and the medium carry amount determination process. Consequently, it is only necessary for the user to select icon 92, regardless of whether the reason why the state of the image quality is "streaky" is clogging of the nozzles or the carry amount by which the medium is carried, or both.

Accordingly, in the present embodiment, since icons 91, 92 and 93 display states of image quality, the user can accurately select the proper icon for letting the printer 1 carry out the adjustment process by merely looking at the state of image quality of the printed print paper P.

Other Embodiments

In the foregoing, a printing apparatus, such as a printer, of the present invention was described according to an embodiment thereof. However, the foregoing embodiment is for the purpose of elucidating the present invention and is not to be interpreted as limiting the present invention. The invention can of course be altered and improved without departing from the gist thereof and includes equivalents. In particular, the embodiments noted below are also included in the printing apparatus according to the invention.

In this embodiment, some or all of the configurations achieved by hardware may be replaced by software, and conversely, some of the configurations that are achieved by software can be replaced by hardware.

In addition to the print paper P, the medium to be printed also may be cloth or film, for example.

Regarding the Liquid

The liquid of the present invention is not limited to ink, such as dye ink or pigment ink, as described above, and it is also possible to adopt liquids (including water) including metallic material, organic material (particularly macromolecular material), magnetic material, conductive material, wiring material, film-formation material, electronic ink, machining liquid, or genetic solutions, for example. Moreover, as regards the constituents of the liquid, the dissolving agent may be solvents, other than water, that constitute a liquid.

Regarding the Medium

As for the medium, it is possible to use plain paper, matte paper, cut paper, glossy paper, roll paper, regular paper, photographic paper, and roll-type photographic paper, for example, as the paper described above. In addition to these, it is also possible to use film material such as OHP film or glossy film, cloth material, and sheet metal material, for example. In other words, any medium that can be printed on can be used.

In printers, the image quality of printed images may drop for various reasons. In this case, the user can enter, into the printer through the user interface, an instruction to carry out an adjustment, and can thus improve the drop in image quality. However, if the user is not well versed in the printer's functionality, the user may not know the reason why the image quality of the printed image has dropped, so that there is the possibility that the user cannot enter, through the user interface and into the printer, the proper instruction for carrying out the adjustment and thus cannot perform adequate improvement of the image quality.

Accordingly, with the above-described embodiments, when an instruction has been entered via the user interface, the ink ejecting section forms patterns for adjusting a plurality of different objects, these different patterns are detected by a sensor, and the plurality of objects are adjusted in accordance with the detection results of these patterns. In the second embodiment, a plurality of image-quality display sections representing different image-quality states are displayed on a user interface into which the user can enter instructions, the image-quality display sections respectively corresponding to adjustment processes for adjusting a plurality of different objects. If the user selects one of these image-quality display sections, then the adjustment process corresponding to the selected image-quality display section is carried out. Also, at least one of the image-quality display sections corresponds to a plurality of adjustment processes for adjusting the objects. Moreover, in the present embodiment, the plurality of objects were the clogging of the nozzles, the ink ejection timing, and the medium carry amount. However, the objects to be adjusted are not limited to the clogging of the nozzles, the ink ejection timing, and the medium carry amount. Needless to say, other objects contributing to an improvement of image quality may be adjusted as well. For example, if the carriage moves in one direction, then the position of dots formed by a given nozzle row and the position of dots formed by another nozzle row may be adjusted.

Moreover, in the second embodiment, icon 91 corresponds to the dot formation position correction process, icon 92 corresponds to the ejection test process and the medium carry amount determination process, and icon 93 corresponds to a combination of the process corresponding to icon 91 and the processes corresponding to icon 92. However, it is also possible to let icon 93 correspond to a combination with further processes in addition to the process corresponding to icon 91 and the processes corresponding to icon 92.

Furthermore, icon 93 corresponds to a combination of the process corresponding to icon 91 and the processes corresponding to icon 92, but icon 93 is not necessarily required. That is to say, if an icon corresponding to a plurality of processes, such as icon 92, is provided on the user interface, then even a user who is not very well versed in the functionality of the printer will be able to improve image quality adequately by selecting icon 92.

Furthermore, with the present embodiment, when an instruction has been entered via the user interface by a user, the ink ejecting section forms patterns for adjusting a plurality of different objects, these different patterns are detected by a sensor, and the plurality of objects are adjusted in accordance with the detection results of these patterns. Also, in the present embodiment, the sensor is an optical sensor including a light-emitting section for irradiating light onto the pattern formed by the ink ejected onto the medium and a light-receiving section for detecting the light that is reflected from that pattern. However, the sensor is not limited to optical sensors. As long as the sensor can detect patterns formed on the medium, it may also be a sensor other than an optical sensor.

Moreover, in the present embodiment, patterns for adjusting a plurality of different objects are formed.

If clogging of the nozzles is the object of adjustment, then the patterns are made of a plurality of blocks, and each block is made of ink ejected from a specific nozzle of among a plurality of nozzles. However, as long as it is suitable for adjusting the clogging of nozzles, the pattern is not limited to the above-described form.

Moreover, if the timing at which ink is ejected from the ink ejecting section is the object of adjustment, then the pattern is made of a plurality of correction patterns, and each correction pattern includes a first dot row group formed by ink ejected by the moving ink ejecting section in a forward pass and a second dot row group formed by ink ejected by the moving ink ejecting section in a return pass. The first dot row group has a plurality of dot rows formed at a predetermined pitch in the movement direction of the ink ejecting section, and the second dot row group has a plurality of dot rows formed at the same pitch as the dot rows of the first dot row group. The amounts that the first dot row group is shifted with respect to the second dot row group are varied by a predetermined difference for each correction pattern. However, as long as it is suitable for adjusting the timing of the ink ejection, the pattern is not limited to the above-described form.

Moreover, if the carry amount by which the medium is carried is the object of adjustment, then the pattern includes a plurality of boundary regions constituted by a first pattern formed by ink that is ejected from a portion of the ink ejecting section that is located upstream in the carrying direction and a second pattern formed by ink that is ejected from a portion of the ink ejecting section that is located downstream in the carrying direction and adjacent to the first pattern upstream in the carrying direction, and the plurality of boundary regions are formed such that the spacing between the first pattern and the second pattern differs for each boundary region. However, as long as it is suitable for adjusting the medium carry amount, the pattern is not limited to the above-described form.

What is claimed is:

1. A method for adjustment of a printing apparatus, comprising:

receiving an instruction from a user via a user interface;

upon receiving said instruction, forming a plurality of patterns on a medium using an ink ejecting section that elects ink onto said medium, each of said patterns being a pattern for adjusting a different object;

detecting each of said patterns with a sensor; and adjusting each of the plurality of objects based on a result of detecting each of said patterns wherein said ink electing section is capable of moving while ejecting ink;

wherein one of said plurality of objects is a timing at which ink is ejected from the moving ink ejecting section;

wherein the pattern for adjusting said timing is made of a plurality of correction patterns;

wherein each of said correction patterns comprises a first dot row group formed by the ink ejected by said moving ink ejecting section in a forward pass and a second dot row group formed by the ink ejected by said moving ink ejecting section in a return pass;

wherein said first dot row group comprises a plurality of dot rows formed at a predetermined pitch in a movement direction of said ink ejecting section;

wherein said second dot row group comprises a plurality of dot rows formed at the same pitch as the dot rows of said first dot row group; and wherein a shift amount of each of said correction patterns by which said first dot row group is shifted with respect to said second dot row group is different from the shift amount of another one of said correction patterns by a predetermined difference.

2. A method for adjustment of a printing apparatus, comprising:

receiving an instruction from a user via a user interface;

upon receiving said instruction, forming a plurality of patterns on a medium using an ink ejecting that ejects ink onto said medium, each of said patterns being a pattern for adjusting a different object;

detecting each of said patterns with a sensor; and adjusting each of the plurality of objects based on a result of detecting each of said patterns wherein said ink ejecting section is capable of moving while ejecting ink;

wherein one of said plurality of objects is a timing at which ink is ejected from the moving ink ejecting section;

wherein the pattern for adjusting said timing is made of a plurality of correction patterns;

wherein each of said correction patterns comprises a first dot row group formed by the ink ejected by said moving ink ejecting section in a forward pass and a second dot row group formed by the ink ejected by said moving ink electing section in a return pass;

wherein the pattern for adjusting said timing comprises a fine adjustment pattern in which the predetermined difference between the shift amounts is small and a coarse adjustment pattern in which the predetermined difference between the shift amounts is larger than the predetermined pitch of said fine adjustment pattern; and wherein said fine adjustment pattern is formed in accordance with the shift amount determined based on said coarse adjustment pattern.

* * * * *